US010499141B2

(12) United States Patent
Kim et al.

(10) Patent No.: US 10,499,141 B2
(45) Date of Patent: Dec. 3, 2019

(54) WIDEBAND SLOT-LOADING LOUDSPEAKER

(71) Applicant: SAMSUNG ELECTRONICS CO., LTD., Suwon-si, Gyeonggi-do (KR)

(72) Inventors: Jong-bae Kim, Seoul (KR); Sung-ha Son, Suwon-si (KR); Gyeong-tae Lee, Seoul (KR); Sung-joo Kim, Suwon-si (KR); Young-sang Lee, Siheung-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/672,828

(22) Filed: Aug. 9, 2017

(65) Prior Publication Data

US 2018/0070167 A1 Mar. 8, 2018

(30) Foreign Application Priority Data

Sep. 2, 2016 (KR) ..... 10-2016-0113423

(51) Int. Cl.

| | |
|---|---|
| ***H04R 25/00*** | (2006.01) |
| ***H04R 1/28*** | (2006.01) |
| ***H04R 1/02*** | (2006.01) |
| ***H04R 5/02*** | (2006.01) |
| *H04R 1/26* | (2006.01) |

(52) U.S. Cl.

CPC ..... *H04R 1/2803* (2013.01); *H04R 1/025* (2013.01); *H04R 5/02* (2013.01); *H04R 1/26* (2013.01); *H04R 2499/15* (2013.01)

(58) Field of Classification Search

CPC ..... H04R 1/2803

USPC ..... 381/345, 346, 347, 350

See application file for complete search history.

(56) References Cited

U.S. PATENT DOCUMENTS

| | | | | |
|---|---|---|---|---|
| 5,790,679 | A * | 8/1998 | Hawker | H04M 1/0202 379/388.02 |
| 7,433,483 | B2 | 10/2008 | Fincham | |
| 7,457,425 | B2 | 11/2008 | Fincham | |
| 7,953,461 | B2 | 5/2011 | Fukazawa | |
| 8,027,500 | B2 | 9/2011 | Fincham | |
| 8,457,340 | B2 | 6/2013 | Fincham | |
| 8,953,831 | B2 | 2/2015 | Jankovsky et al. | |
| 9,107,003 | B2 * | 8/2015 | Dix | H04R 1/2873 |
| 2006/0187364 | A1 * | 8/2006 | Fukano | H04N 5/642 348/836 |

(Continued)

FOREIGN PATENT DOCUMENTS

| | | |
|---|---|---|
| JP | 4853029 | 1/2012 |
| JP | 5611068 | 10/2014 |
| WO | WO 2011/010713 | 1/2011 |

*Primary Examiner* — Phylesha Dabney

(74) *Attorney, Agent, or Firm* — Nixon & Vanderhye P.C.

(57) ABSTRACT

A wideband slot-loading loudspeaker includes a speaker driver configured to reproduce sound; an enclosure in which the speaker driver is disposed; a reflective member spaced apart from a front surface of the speaker driver, wherein a slot is formed in a space between the speaker driver and the reflective member; an acoustic discharge port provided at one end of the slot, the acoustic discharge port configured to discharge the sound reproduced by the speaker driver; at least one opening provided in the reflective member; and a sound resistance member disposed at the at least one opening.

15 Claims, 51 Drawing Sheets

(56) References Cited

U.S. PATENT DOCUMENTS

| | | | | |
|---|---|---|---|---|
| 2011/0188678 | A1 | 8/2011 | Lee et al. | |
| 2011/0268309 | A1 | 11/2011 | Moquin et al. | |
| 2012/0106766 | A1 | 5/2012 | Kuroda | |
| 2013/0279730 | A1* | 10/2013 | Tanaka | H04R 1/021 381/333 |
| 2014/0029779 | A1* | 1/2014 | Yamauchi | H04N 5/642 381/333 |
| 2014/0105426 | A1 | 4/2014 | Fincham | |
| 2014/0247959 | A1* | 9/2014 | Yamanaka | H04R 1/345 381/388 |
| 2015/0010190 | A1* | 1/2015 | Lee | H04R 1/2807 381/353 |
| 2015/0053497 | A1* | 2/2015 | Horiuchi | H04N 5/642 181/199 |
| 2015/0256922 | A1 | 9/2015 | Shi | |
| 2016/0191097 | A1* | 6/2016 | Huh | H04R 1/345 455/575.1 |

* cited by examiner

WIDEBAND SLOT-LOADING LOUDSPEAKER

CROSS-REFERENCE TO RELATED APPLICATION

This application is based on and claims priority under 35 U.S.C. § 119 to Korean Patent Application No. 10-2016-0113423 filed Sep. 2, 2016 in the Korean Intellectual Property Office, the disclosure of which is incorporated by reference herein in its entirety.

BACKGROUND

1. Field

The present disclosure relates generally to a loudspeaker. For example, the present disclosure relates to a slot-loading loudspeaker that emits sound through a slot.

2. Description of Related Art

Recently, in electronic devices such as a television, a mobile device, or the like, a size of a display on which an image is displayed is maximized. However, in order to make the overall size of the electronic device as small as possible, the electronic device has been designed with a thinner thickness and a minimized or no bezel.

In the electronic device of this design, a speaker for reproducing sound is provided to discharge sound to the outside while being hidden inside the electronic device.

For example, as illustrated in FIG. 1, a speaker system 2 may be designed so that the speaker system 2 is not visible in front of the image display apparatus 1 by providing the speaker system 2 at the lower end of the rear surface of an image display apparatus 1. In this case, a speaker diaphragm of a speaker driver 3 is provided to radiate sound toward the bottom surface where the image display apparatus 1 is installed. In other words, the speaker driver 3 is disposed in a down firing structure. However, this design has a problem that the thickness of the image display apparatus 1 cannot be thinner than the width of the speaker diaphragm of the speaker driver 3. If the area of the speaker diaphragm is reduced in order to reduce the thickness of the image display apparatus 1, the volume of the speaker driver 3 is decreased and the reproduction band of the low frequency of the speaker driver 3 is reduced.

To solve these problems, as illustrated in FIG. 2, a slot-loading loudspeaker system 6 in which a speaker diaphragm 8 of a speaker driver 7 is provided in parallel to a display 5 and sound reproduced by the speaker driver 7 is discharged to the outside through a waveguide 9 has been proposed.

The slot-loading loudspeaker system 6 according to the related art can reduce the thickness of the image display apparatus 1'. However, as illustrated in FIG. 3, in the slot-loading loudspeaker system 6 according to the related art, a very large peak occurs in the high frequency band, and a large volume attenuation and a large number of peaks and dips occur in a higher frequency. Therefore, when the slot-loading loudspeaker system 6 is used alone, there is a problem in the reproduction performance of the high frequency band. In FIG. 3, a line ① indicates the sound pressure of a front duct, a line ② indicates the sound pressure of a rear duct, a line ③ indicates the overall sound pressure, and a line ④ indicates the measured sound pressure.

In order to solve this problem, image display apparatuses currently on the market are configured so that an active filter, in particular, a parametric equalizer EQ is utilized to correct frequency distortion caused by a slot-loading loudspeaker structure, and the large number of peaks and dips in high frequency are subjected to a low-pass filtering and then reproduced using a separate high frequency tweeter for high frequency reproduction.

Accordingly, the development of a wideband slot-loading loudspeaker having the same or similar high frequency reproduction performance as that of a conventional exposed loudspeaker by improving the reproduction performance of the high frequency band of the slot-loading loudspeaker is required.

SUMMARY

The present disclosure has been developed in order to address the above drawbacks and other problems associated with the conventional arrangement. An example aspect of the present disclosure relates to a wideband slot-loading loudspeaker with improved reproducing performance in a high frequency band as compared to a conventional slot-loading loudspeaker. For example, the present disclosure relates to a wideband slot-loading loudspeaker that can address problems occurring due to peaks and dips occurring at a specific frequency of several kHz caused by a resonance mode of a slot and a waveguide inside a speaker driver when used alone and improve a high frequency range bandwidth caused by a front waveguide of a slot-loading loudspeaker.

According to an example aspect of the present disclosure, a wideband slot-loading loudspeaker may include a speaker driver configured to reproduce sound; an enclosure in which the speaker driver is disposed; a reflective member spaced apart from a front surface of the speaker driver, wherein a slot is formed in a space between the speaker driver and the reflective member; an acoustic discharge port provided at one end of the slot, the acoustic discharge port configured to discharge the sound reproduced by the speaker driver; at least one opening provided in the reflective member; and a sound resistance member disposed at the at least one opening.

The reflective member may include a reflective plate disposed to face the front surface of the speaker driver; and a sidewall connecting the reflective plate and a circumference of the speaker driver.

The acoustic discharge port may be formed substantially perpendicular to or parallel to a plane extending from the front surface of the speaker driver.

The at least one opening may be provided in the reflective member to be adjacent to or farther from the acoustic discharge port.

The at least one opening may include at least two holes which are provided in a straight line. The at least two holes may be provided substantially parallel to or to be inclined with respect to one end of the reflective member at which the acoustic discharge port is provided.

The at least one opening may include a slit of a length corresponding to a length of one side of the front surface of the speaker driver.

The sound resistance member may include one of a mesh and a sponge.

A wideband slot-loading loudspeaker having the above-described features may be applied to an image display apparatus, a mobile device, and a speaker system.

Other objects, advantages and salient features of the present disclosure will become apparent from the following detailed description, which, taken in conjunction with the annexed drawings, discloses various example embodiments.

BRIEF DESCRIPTION OF THE DRAWINGS

These and/or other aspects, features and attendant advantages of the present disclosure will become apparent and more readily appreciated from the following detailed description, taken in conjunction with the accompanying drawings, in which like reference numerals refer to like elements, and wherein.

Throughout the drawings, like reference numerals will be understood to refer to like parts, components and structures.

DETAILED DESCRIPTION

Hereinafter, various example embodiments of the present disclosure will be described in greater detail with reference to the accompanying drawings.

The matters defined herein, such as a detailed construction and elements thereof, are provided to assist in a comprehensive understanding of this description. Thus, it is apparent that various example embodiments may be carried out without those defined matters. Also, well-known functions or constructions may be omitted to provide a clear and concise description of example embodiments. Further, dimensions of various elements in the accompanying drawings may be arbitrarily increased or decreased for assisting in a comprehensive understanding.

Figure 4:
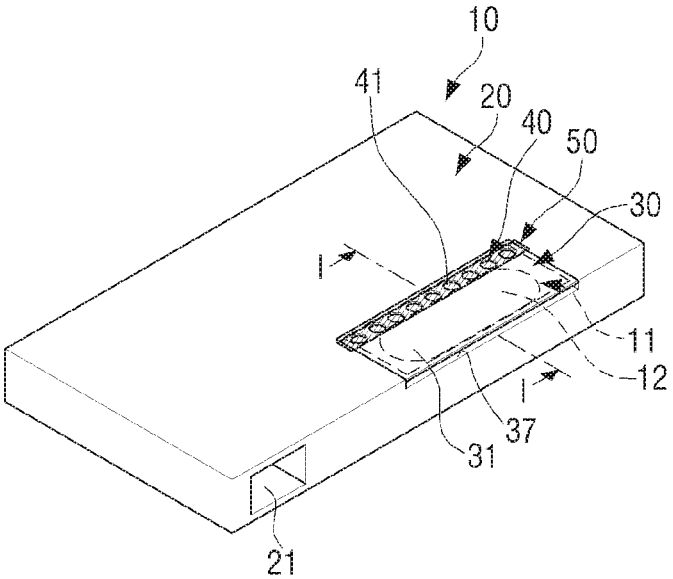
FIG. 4 is a perspective view illustrating an example wideband slot-loading loudspeaker according to an example embodiment of the present disclosure.
Figure 5:
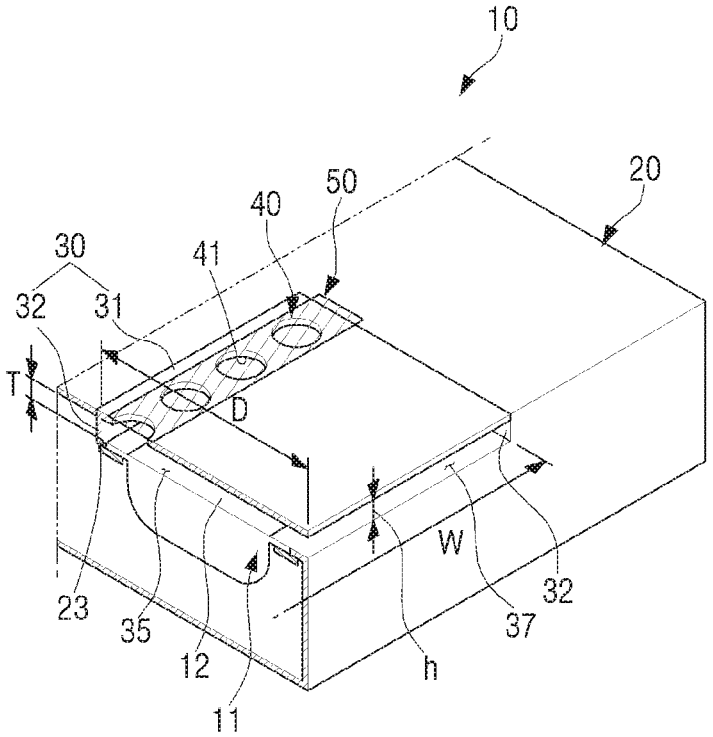
FIG. 5 is a partial cross-sectional perspective view illustrating the wideband slot-loading loudspeaker of FIG. 4 taken along a line I-I.

FIG. 4 is a perspective view illustrating an example wideband slot-loading loudspeaker according to an example embodiment of the present disclosure. FIG. 5 is a partial cross-sectional perspective view illustrating the example wideband slot-loading loudspeaker of FIG. 4 taken along a line I-I.

Referring to FIGS. 4 and 5, a wideband slot-loading loudspeaker 10 according to an example embodiment of the present disclosure may include a speaker driver 11, an enclosure 20, and a reflective member 30.

The speaker driver 11 reproduces sound (or audio) according to an input signal, and may include a speaker diaphragm 12, a suspension system, and an electric motor system (not shown).

The enclosure 20 is formed to fix the speaker driver 11 and to prevent and/or reduce sounds having mutually opposite phase generated in front of and behind the speaker driver 11 from being immediately mixed. For example, the enclosure 20 is provided to prevent and/or reduce the sound generated in front of the speaker diaphragm 12 of the speaker driver 11 from being immediately mixed with the sound generated behind the speaker diaphragm 12. For example, the enclosure 20 may be configured so that the sound generated behind the speaker driver 11 is emitted to the outside through appropriate filtering. The enclosure 20 as illustrated in FIG. 4 is configured so that the sound generated behind the speaker driver 11 is emitted to the outside of the enclosure 20 through a duct 21.

The reflective member 30 is disposed in front of the speaker driver 11 and forms a slot 35 through which sound generated in front of the speaker driver 11 is emitted. As one example, the reflective member 30 is provided to face the front surface of the speaker driver 11 from which the sound is output. The reflective member 30 is spaced apart from the front surface of the speaker driver 11, that is, the speaker diaphragm 12 by a predetermined distance, and is provided to cover all or a portion of the front surface of the speaker driver 11.

Accordingly, the reflective member 30 forms the slot 35 through which the sound generated in the front surface of the speaker driver 11 passes in front of the speaker driver 11. An acoustic discharge port 37 to discharge sound is provided at one end of the slot 35. In other words, the acoustic discharge port 37 is provided under one end of the reflective member 30. The acoustic discharge port 37 may be provided in a plane intersecting a plane extending from the front surface of the speaker driver 11. At this time, the plane extending from the front surface of the speaker driver 11 and the plane in which the acoustic discharge port 37 is provided may be formed to be substantially perpendicular to each other. The slot 35 formed by the reflective member 30 forms an acoustic tube (or waveguide) for guiding the sound generated in the front surface of the speaker driver 11 to the acoustic discharge port 37.

For example, the reflective member 30 may include a reflective plate 31 and a sidewall 32. The reflective plate 31 is disposed substantially parallel to the plane extending from the front surface of the speaker driver 11 and reflects the sound generated in the front surface of the speaker driver 11. The sidewall 32 is disposed around the speaker driver 11 so that sound generated in the front surface of the speaker driver 11 is discharged through the acoustic discharge port 37. Therefore, the sidewall 32 is not disposed at the portion provided with the acoustic discharge port 37. The sidewall 32 is formed to connect the reflective plate 31 and a mounting surface 23 of the enclosure 20 in which the speaker driver 11 is disposed.

The reflective member 30 is provided with at least one opening 40. In detail, the at least one opening 40 is provided in the reflective plate 31 of the reflective member 30. The at least one opening 40 may function to reduce the resonance peak strongly generated at the high attenuation frequency defined by the slot 35 and to increase the high frequency response bandwidth. The at least one opening 40 may be formed in various shapes. Therefore, the at least one opening 40 will be described in detail below.

In addition, the reflective member 30 may include a sound resistance member 50 disposed in the at least one opening 40. The sound resistance member 50 is disposed to cover the at least one opening 40. Alternatively, the sound resistance member 50 may be disposed inside the at least one opening 40. Accordingly, the sound generated in front of the speaker driver 11 may be discharged outside of the slot 35 formed by the reflective member 30 after the peaks and dips are controlled through the at least one opening 40 and the sound resistance member 50. The sound resistance member 50 functions to control the volume velocity of at least one opening 40 and to adjust the sound pressure generated in the slot 35 on a frequency-by-frequency basis. The sound resistance member 50 may be formed of an acoustic resistive material such as a mesh, a sponge, or the like.

Hereinafter, the function of each component of the example wideband slot-loading loudspeaker 10 according to an embodiment of the present disclosure will be described in detail.

The duct 21 provided in the enclosure 20 of the wideband slot-loading loudspeaker 10 determines the characteristics of the low frequency attenuation portion together with the volume of the enclosure 20. By the duct 21, a user may hear the sound generated in front of the speaker driver 11 together with the sound that is generated behind the speaker driver 11, resonated by the enclosure 20 and the duct 21, and discharged through the duct 21. In other words, the low-band limit frequency performance may be determined by the combination of the duct 21 and the volume of the enclosure 20 together with speaker parameters such as free resonance frequency, compliance, damping factor, and the like of the speaker determining the low frequency of the speaker driver 11. In some slim enclosures, the dip and peak may be determined by the positions of the speaker driver 11 and the duct 21 and the shape of the enclosure 20.

Figure 6:
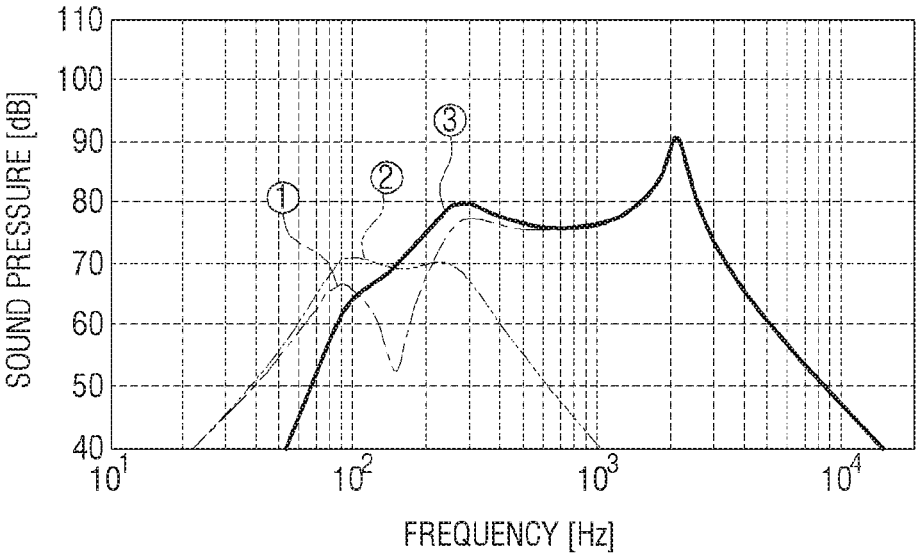
FIG. 6 is a frequency-sound pressure simulation graph when a duct is provided in an enclosure of a conventional slot-loading loudspeaker.

FIG. 6 is a frequency-sound pressure graph obtained by lumped parameter modeling of a sound when a duct is provided in an enclosure of a conventional slot-loading loudspeaker.

In FIG. 6, a line ① indicates a sound coming out through the acoustic discharge port 37 of the slot 35, a line ② indicates a sound coming out through the duct 21, and a line ③ indicates a sound where the sounds of the line ① and the line ② are mixed. Both the conventional slot-loading loudspeaker in which a duct is provided and the wideband slot-loading loudspeaker 10 according to an example embodiment of the present disclosure are similar in that the low frequency region is extended by the duct.

The wideband slot-loading loudspeaker 10 according to an embodiment of the present disclosure as illustrated in FIG. 4 includes the duct 21 provided in the enclosure 20, but the enclosure 20 may not include the duct 21. In this case, the sound generated behind the speaker driver 11 is not emitted to the outside, so the sound reproduced by the wideband slot-loading loudspeaker 10 is the sound generated in front of the speaker driver 11.

Figure 7:
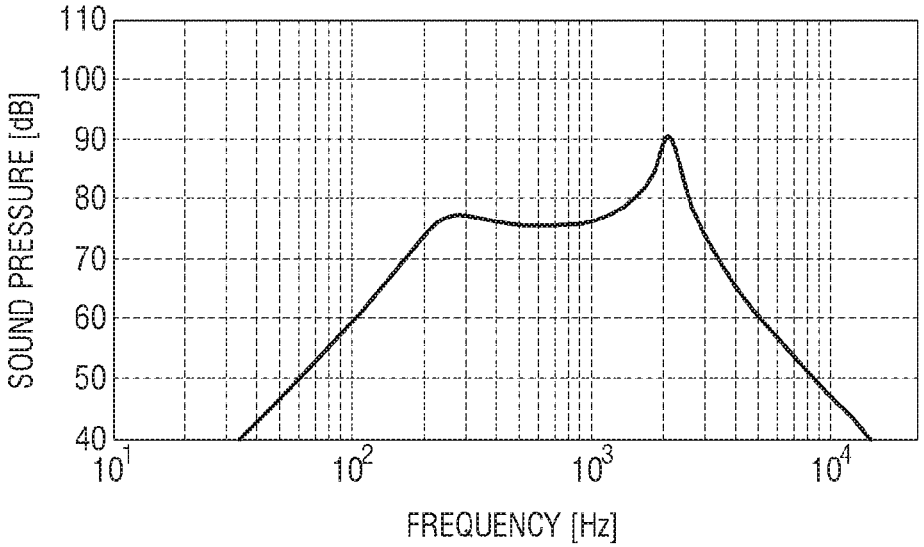
FIG. 7 is a frequency-sound pressure simulation graph when an enclosure of a conventional slot-loading loudspeaker is sealed without a duct.

FIG. 7 is a frequency-sound pressure graph obtained by lumped parameter modeling of the sound when an enclosure of a conventional slot-loading loudspeaker is sealed without a duct.

Comparing FIG. 6 with FIG. 7, it can be seen that the enclosure 20 with the duct 21 improves the sound reproduction performance in the low frequency band compared with the closed type enclosure.

The slot 35 provided in front of the speaker driver 11 is generally related to the high frequency attenuation of the slot-loading loudspeaker 10. In particular, the depth D of the slot 35 is a key factor in determining the amount of the high frequency attenuation.

Referring to FIG. 5, the thickness T of the slot 35 is the distance between the front surface of the speaker driver 11, that is, the speaker diaphragm 12 and the reflective plate 31, and the width W of the slot 35 represents the length of the acoustic discharge port 37. The depth (or length) D of the slot 35 is the distance from the acoustic discharge port 37 to the sidewall 32 facing the acoustic discharge port 37. The height h of the acoustic discharge port 37 may be equal to the thickness T of the slot 35. As another example, the height h of the acoustic discharge port 37 may be larger or smaller than the thickness T of the slot 35.

Figure 8:
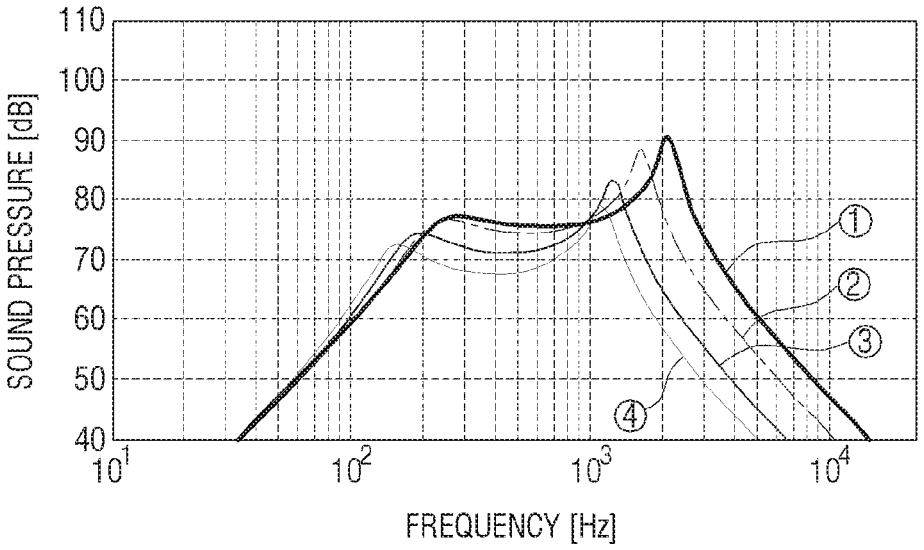
FIG. 8 is a simulation graph illustrating increase in high frequency attenuation and changes in peak frequency based on changes in length of a front slot in a conventional slot-loading loudspeaker.

The result of simulating the amount of high frequency attenuation according to changes in the depth D of the slot 35 of the slot-loading loudspeaker 10 is illustrated in FIG. 8.

FIG. 8 is a graph illustrating increase in high frequency attenuation and changes in peak frequency according to changes in depth of a front slot in a conventional slot-loading loudspeaker.

FIG. 8 is the result of simulating a case in which the width W and the thickness T of the slot 35 are fixed to a predetermined value and the depth D of the slot 35 is deepened by a predetermined value from a predetermined depth. For example, the width W of the slot 35 is fixed at about 90 mm, and the depth D of the slot 35 may be increased by a predetermined value with 30 mm as the basic depth. In FIG. 8, a line ① represents the case where 1 mm is added to the basic depth of the slot 35 (D=31 mm), a line ② represents the case where 10 mm is added to the basic depth of the slot 35 (D=40 mm), a line ③ represents the case where 40 mm is added to the basic depth of the slot 35 (D=70 mm), and a line ④ represents the case where 80 mm is added to the basic depth of the slot 35 (D=110 mm).

Referring to FIG. 8, it can be seen that as the depth of the slot becomes deeper, the high-frequency limit frequency shifts toward the low-frequency side, and the high-frequency roll-off frequency forms a peak of about 10 dB or more compared to the average level. Accordingly, the conventional slot-loading loudspeaker should be configured to process high frequency sounds of 3 kH or more by using a separate tweeter for the high frequency band. In the case of the mid-woofer, the peak at several kHz must be removed before use. For this reason, when the slot-loading loudspeaker is used alone in the full range, the loudness of the high frequency band is insufficient, and when the peak of several kHz is not controlled, the slot-loading loudspeaker may have a frequency characteristic that emphasizes linear distortion and unpleasant frequencies.

Figure 9:
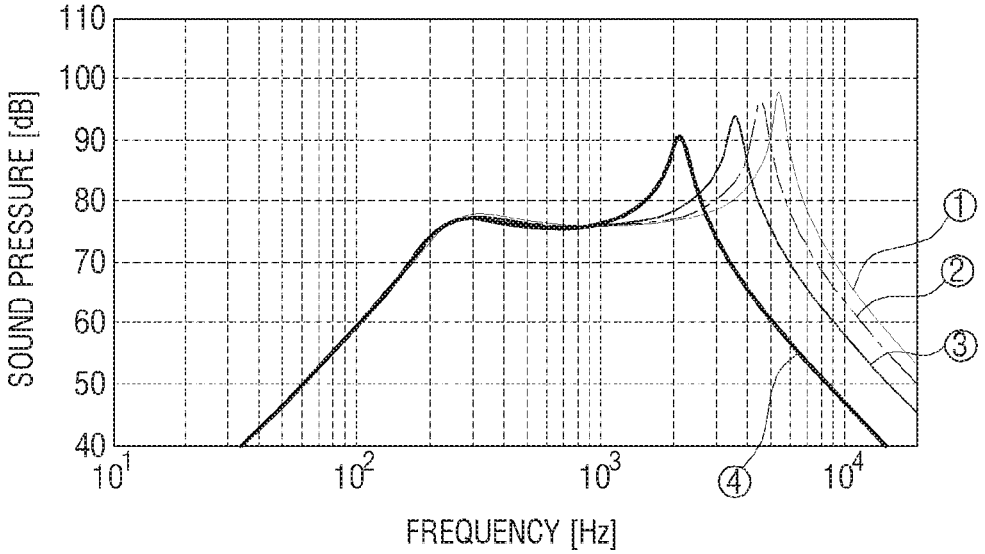
FIG. 9 is a simulation graph illustrating high frequency magnification and changes in peak frequency based on changes in an opening in a wideband slot-loading loudspeaker according to an embodiment of the present disclosure.

FIG. 9 is a simulation graph illustrating high frequency magnification and changes in peak frequency according to changes in an opening in a wideband slot-loading loudspeaker according to an example embodiment of the present disclosure.

Figure 1:
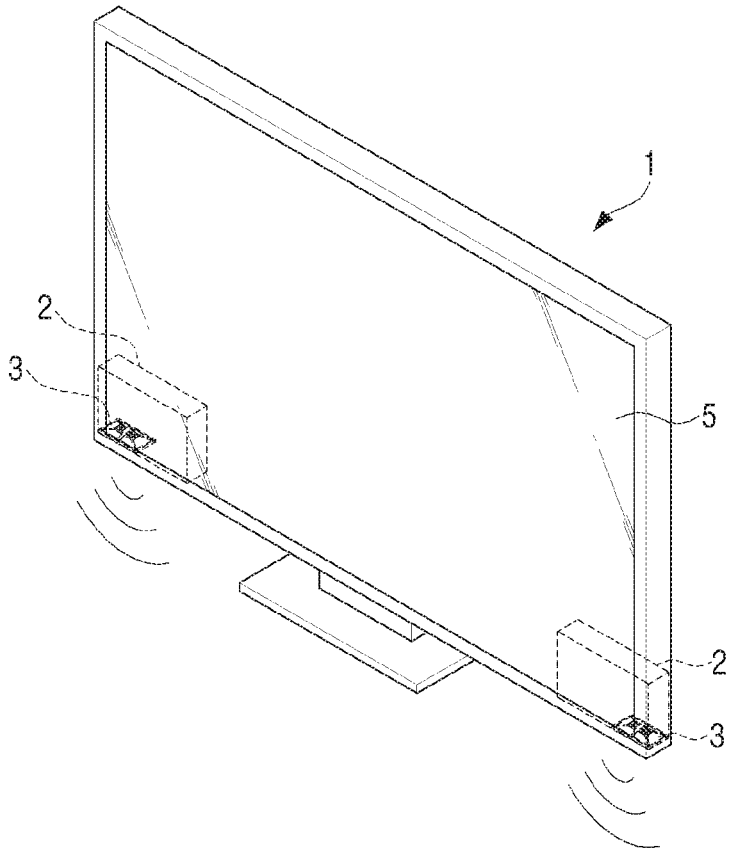
FIG. 1 (CONVENTIONAL ART)
FIG. 1 is a perspective view illustrating a conventional image display apparatus having speakers arranged in a down firing structure.
Figure 2:
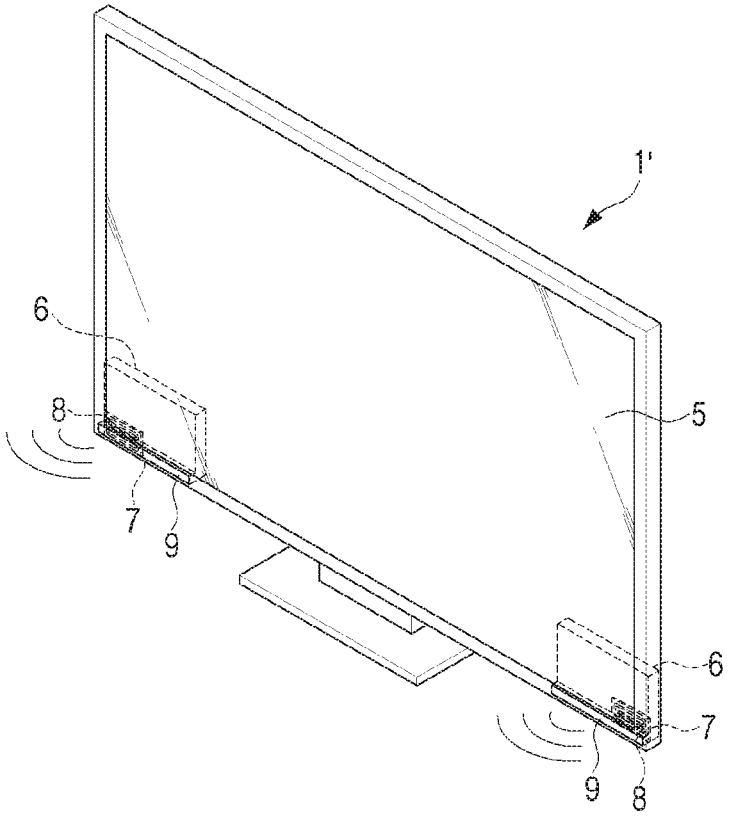
FIG. 2 (CONVENTIONAL ART)
FIG. 2 is a perspective view illustrating a conventional image display apparatus having slot-loading loudspeakers.
Figure 3:
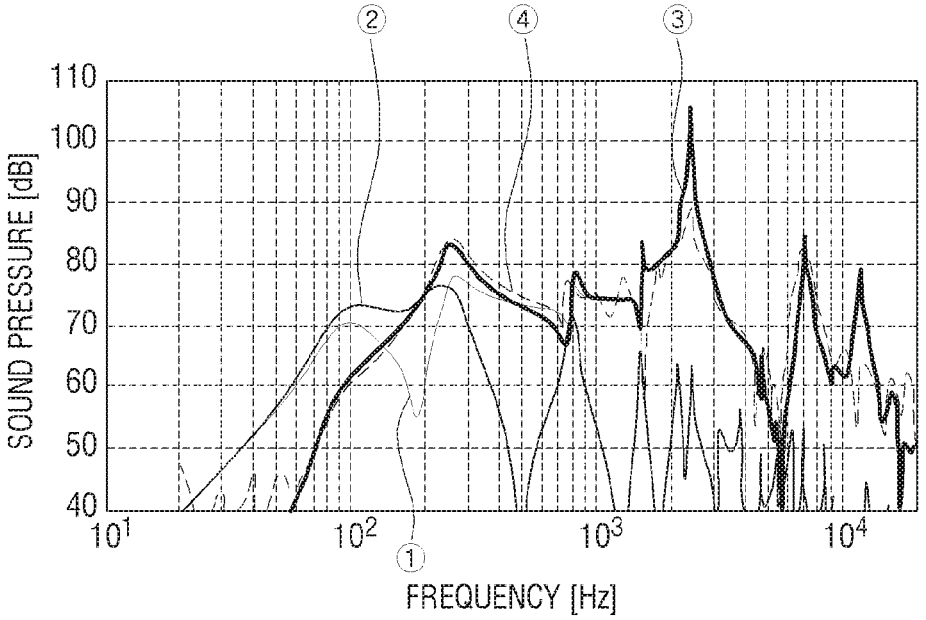
FIG. 3 is a frequency-sound pressure graph illustrating a typical frequency distortion phenomenon of a conventional slot-loading loudspeaker.

The slot-loading loudspeaker of FIG. 9 is provided with only the opening 40, and the sound resistance member 50 of the wideband slot-loading loudspeaker 10 of FIG. 3 is not provided. At this time, the opening 40 is formed in a plurality of holes 41 having a diameter of 5 mm. In FIG. 9, a line ① represents the case where fifteen holes 41 are provided in the reflective plate 31 of the slot 35, a line ② represents the case where ten holes 41 are provided in the reflective plate 31 of the slot 35, a line ③ represents the case where five holes 41 are provided in the reflective plate 31 of the slot 35, and a line ④ represents the case where there is no hole in the reflective plate 31 of the slot 35.

Referring to FIG. 9, it can be seen that as the number of holes 41 increases, that is, as the area of the opening 40 increases, the Helmholtz resonance frequency shifts toward the high frequency band side. Therefore, the slot-loading loudspeaker 10 may obtain the effect of expanding the bandwidth by the opening 40. However, as can be seen in FIG. 9, there still exists a peak caused by the slot 35 at the high band roll-off frequency.

Figure 10:
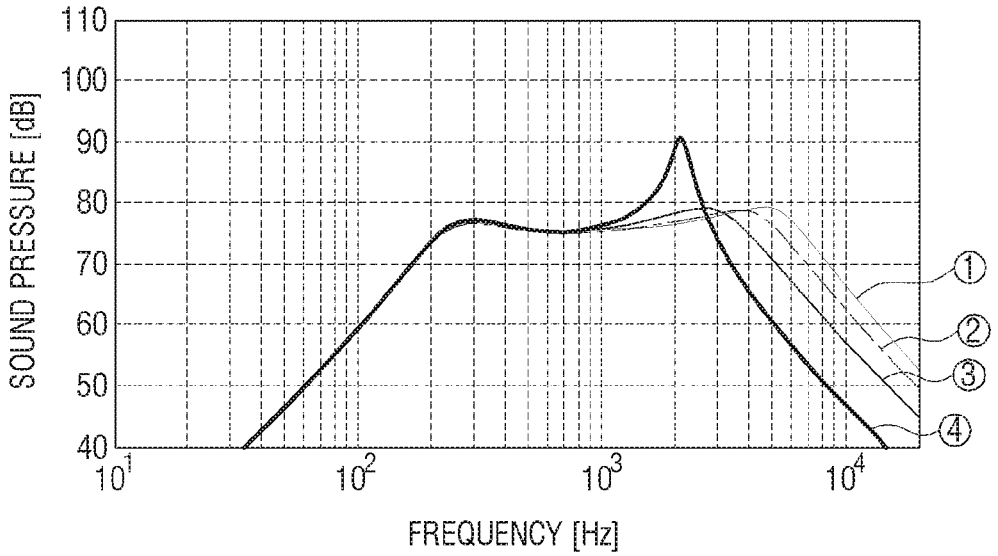
FIG. 10 is a simulation graph illustrating an example effect of attenuating the peak frequency and the high frequency magnification when a sound resistance member is provided in an opening of a wideband slot-loading loudspeaker according to an example embodiment of the present disclosure.

FIG. 10 is a simulation graph illustrating high frequency magnification and changes in peak frequency when a sound resistance member is provided in an opening of a wideband slot-loading loudspeaker according to an example embodiment of the present disclosure.

The slot-loading loudspeaker of FIG. 10 is the case where the sound resistance member 50 is provided in the opening 40 of the slot-loading loudspeaker of FIG. 9. In other words, FIG. 10 is a simulation graph illustrating frequency characteristics of the wideband slot-loading loudspeaker 10 according to an embodiment of the present disclosure. In FIG. 10, a line ① represents the case where fifteen holes 41 and a sound resistance member 50 are provided in the reflective plate 31 of the slot 35, a line ② represents the case where ten holes 41 and the sound resistance member 50 are provided in the reflective plate 31 of the slot 35, a line ③ represents the case where five holes 41 and the sound resistance member 50 are provided in the reflective plate 31 of the slot 35, and a line ④ represents the case where there is no hole in the reflective plate 31 of the slot 35.

Referring to FIG. 10, when the sound resistance member 50 is provided in the plurality of holes 41, that the resonance frequency shifts toward the high frequency band is the same as the slot-loading loudspeaker of FIG. 9 in which the sound resistance member 50 is not provided in the plurality of holes 41. However, that the peak at the high band roll-off frequency is removed is different from the slot-loading loudspeaker of FIG. 9.

Hereinafter, the effect of the wideband slot-loading loudspeaker 10 according to an example embodiment of the present disclosure will be described in comparison with the conventional speaker. For example, a speaker without a slot, a conventional slot-loading loudspeaker with a slot only, a wideband slot-loading loudspeaker 10 according to an embodiment of the present disclosure in which a sound resistance member 50 is not disposed, and a wideband slot-loading loudspeaker 10 according to an embodiment of the present disclosure in which the sound resistance member 50 is disposed are compared in terms of a time domain, a frequency domain, and a time-frequency complex domain.

Figure 11A:
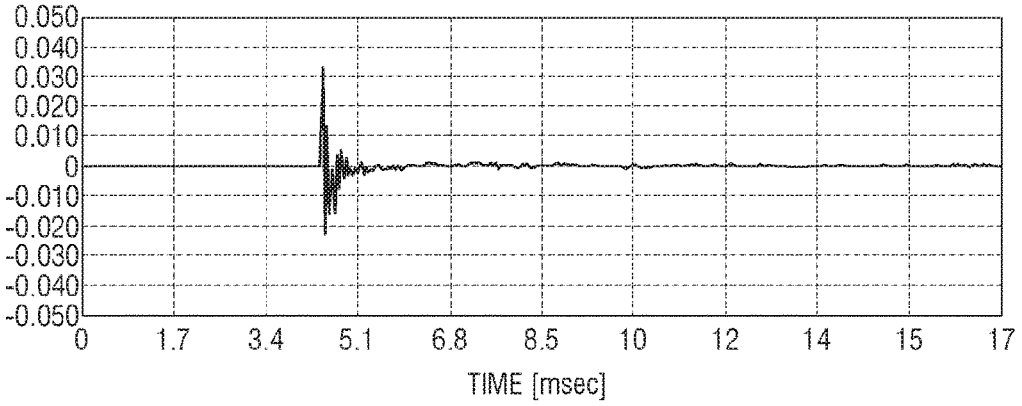
FIG. 11A is an impulse response graph on a time domain side of a conventional loudspeaker without a slot.
Figure 11B:
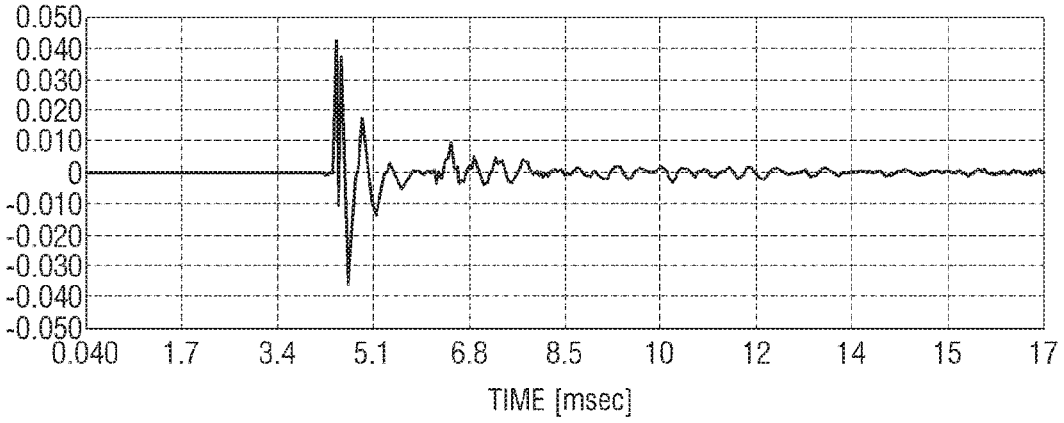
FIG. 11B is an impulse response graph on a time domain side of a conventional loudspeaker with a slot only.
Figure 11C:
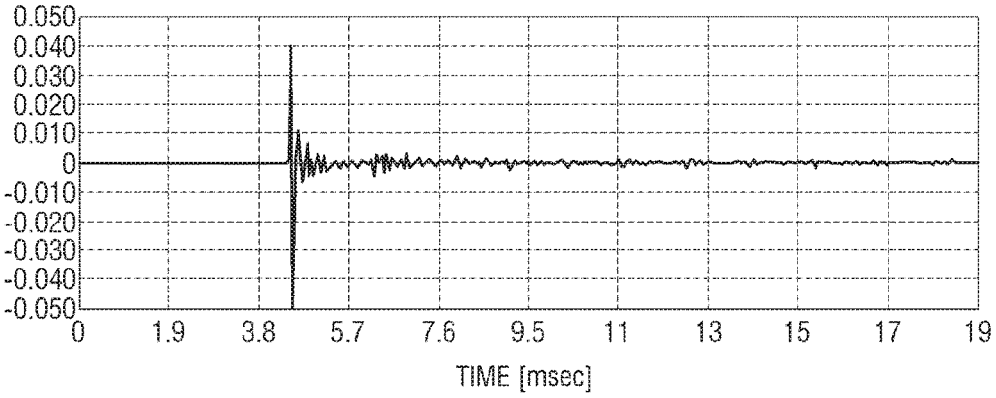
FIG. 11C is an impulse response graph on a time domain side of a wideband slot-loading loudspeaker with an opening according to an example embodiment of the present disclosure.
Figure 11D:
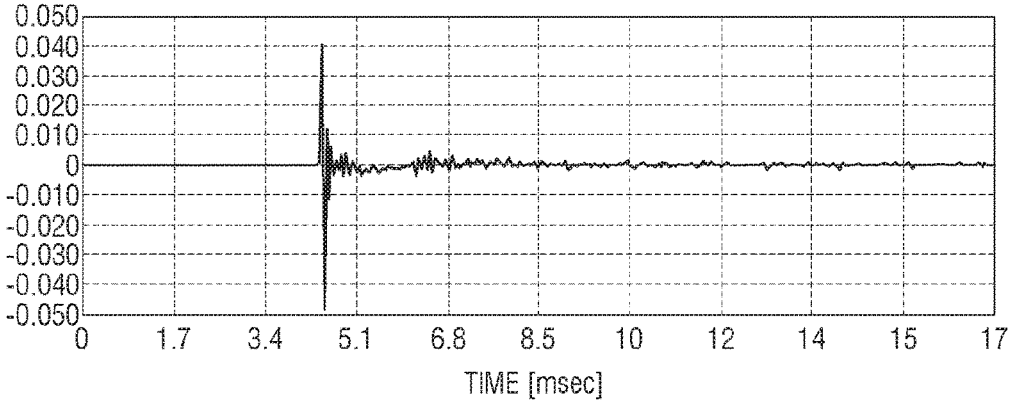
FIG. 11D is an impulse response graph on a time domain side of a wideband slot-loading loudspeaker with an opening and a sound resistance member according to an example embodiment of the present disclosure.

FIG. 11A is a time domain side impulse response measurement graph of a conventional loudspeaker without a slot, and FIG. 11B is a time domain side impulse response measurement graph of a conventional loudspeaker with a slot only. FIG. 11C is a time domain side impulse response measurement graph of a wideband slot-loading loudspeaker with an opening according to an example embodiment of the present disclosure, and FIG. 11D is a time domain side impulse response measurement graph of a wideband slot-loading loudspeaker with an opening and a sound resistance member according to an example embodiment of the present disclosure.

FIGS. 11A to 11D compare the ideal impulse response for the four types of loudspeakers. The general loudspeaker without a slot of FIG. 11A shows fast rising and fast decay. However, in the slot-loading loudspeaker of FIG. 11B, high frequency ringing occurs due to Helmholtz resonance occurring in the slot. It is expressed as a strong peak in the frequency domain. In the case of the slot-loading loudspeaker provided with only the opening in the slot of FIG. 11C, the ringing having a periodicity of 2 kHz may be significantly reduced and fast decay characteristics may be obtained compared with the slot-loading loudspeaker having only the slot of FIG. 11B. However, the level on the time axis is greatly reduced, but a more dense periodic component (about 5-6 kHz) remains. In the case of a slot-loading loudspeaker provided with both the opening and the sound resistance member in the slot of FIG. 11D, the decay is faster and the ringing of 5-6 kHz is also substantially eliminated, so that the response is similar to the ideal loudspeaker of FIG. 11A.

Figure 12A:
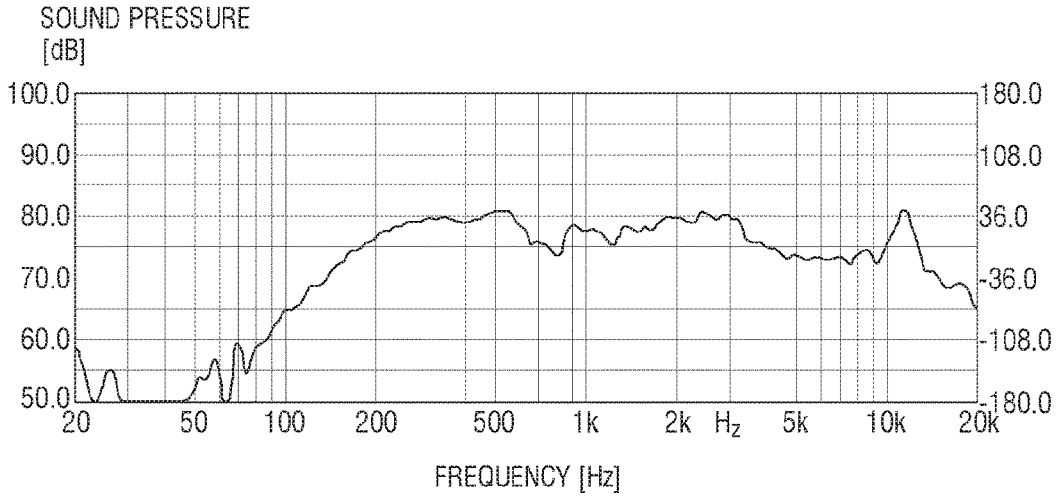
FIG. 12A is a frequency-sound pressure measurement graph on a frequency domain side of a conventional loudspeaker without a slot.
Figure 12B:
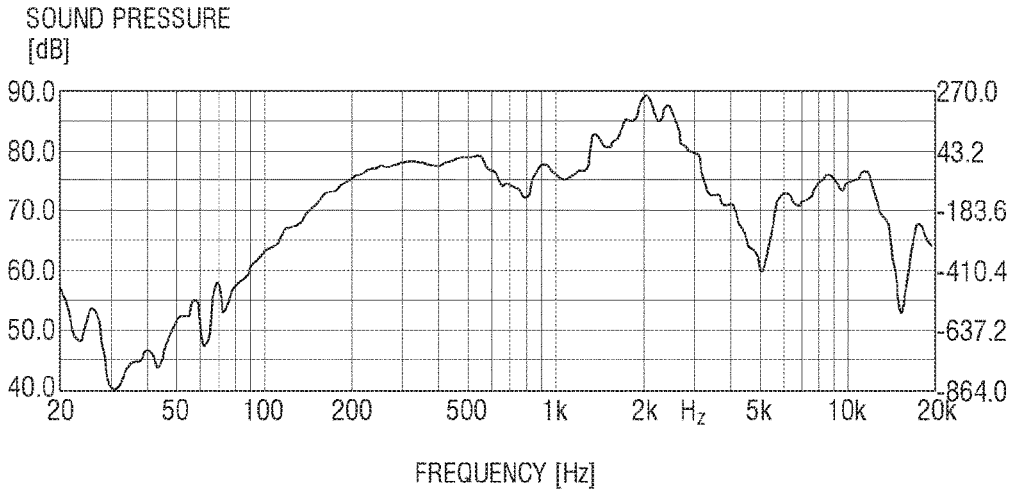
FIG. 12B is a frequency-sound pressure measurement graph on a frequency domain side of a conventional loudspeaker with a slot only.
Figure 12C:
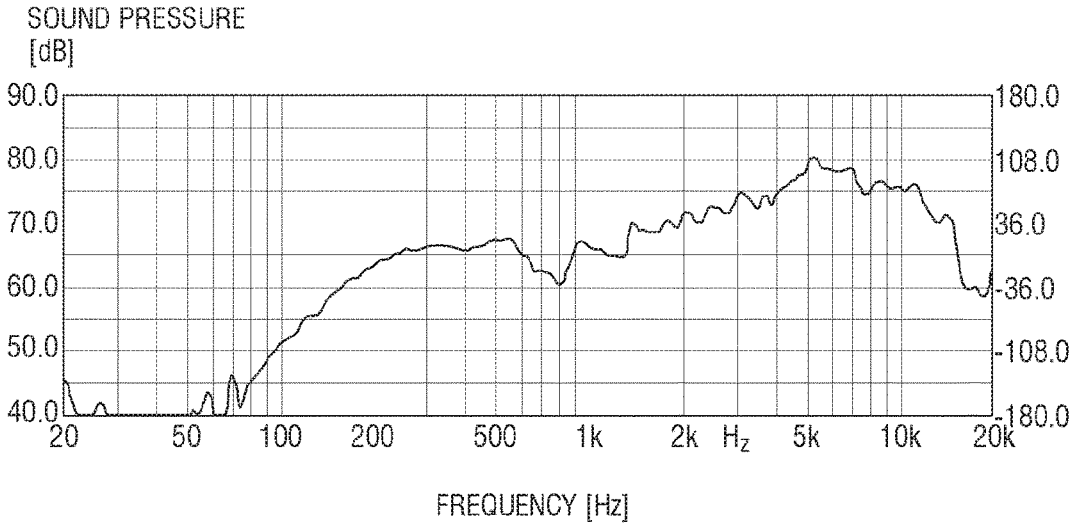
FIG. 12C is a frequency-sound pressure measurement graph on a frequency domain side of a wideband slot-loading loudspeaker with an opening according to an example embodiment of the present disclosure.
Figure 12D:
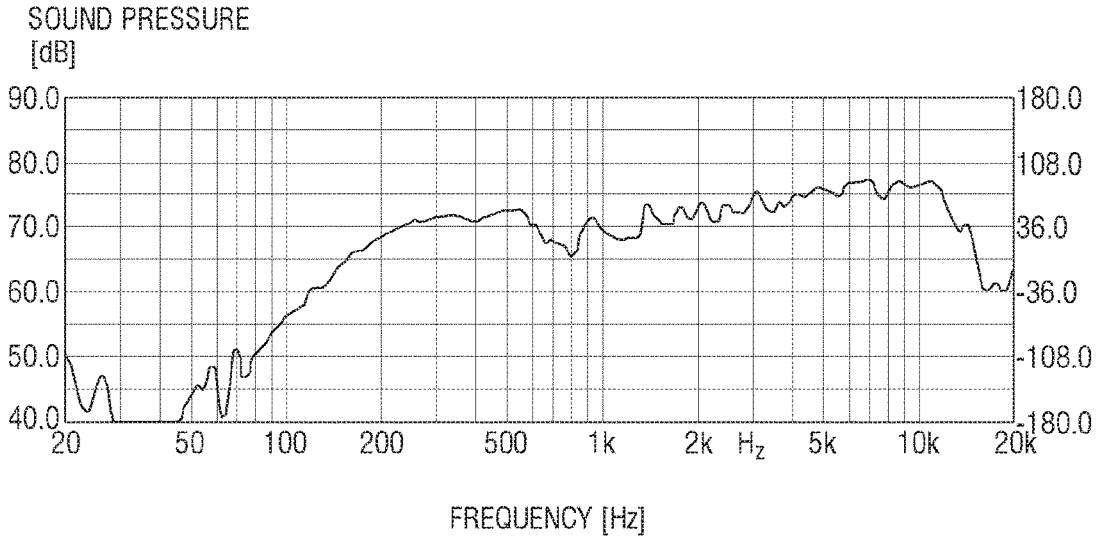
FIG. 12D is a frequency-sound pressure measurement graph on a frequency domain side of a wideband slot-loading loudspeaker with an opening and a sound resistance member according to an example embodiment of the present disclosure.

FIGS. 12A, 12B, 12C and 12D shows results of measuring the four types of loudspeakers as described above in terms of the frequency domain. For example, FIG. 12A is a frequency domain side measurement graph of a conventional loudspeaker without a slot, and FIG. 12B is a frequency domain side measurement graph of a conventional loudspeaker with a slot only. FIG. 12C is a frequency domain side measurement graph of a wideband slot-loading loudspeaker with an opening according to an example embodiment of the present disclosure, and FIG. 12D is a frequency domain side measurement graph of a wideband slot-loading loudspeaker with an opening and a sound resistance member according to an example embodiment of the present disclosure.

In the slot-loading loudspeaker of FIG. 12B, the peak of about 2 kHz and the dip of about 5 kHz are increased by the slot. However, when an opening is provided in the slot-loading loudspeaker, as illustrated in FIG. 12C, the peak of about 2 kHz shifts to the about 5 kHz band and the high frequency band is restored. That is, it can be seen that the high frequency band of the slot-loading loudspeaker is expanded by the opening.

On the other hand, in the case of a wideband slot-loading loudspeaker provided with an opening and a sound resistance member in the slot-loading loudspeaker, as illustrated in FIG. 12D, the peak at the about 5 kHz band is controlled and the overall smoothness of the high frequency band is improved as shown in the simulation result of FIG. 10. In other words, it can be seen that the wideband slot-loading loudspeaker of FIG. 12D becomes similar to the loudspeaker without a slot of FIG. 12A. Also, the sound resistance member appropriately reduces the volume velocity of the sound emitted through the opening, thereby increasing the volume velocity of the sound emitted through the acoustic discharge port of the slot and increasing the sound pressure in the frequency band of 500 Hz or less. Accordingly, the wideband slot-loading loudspeaker 10 according to an embodiment of the present disclosure has an expanded high frequency band, so that a sound of a high frequency band that is lost due to the slot and cannot be reproduced when the conventional slot-loading loudspeaker is used as a full-range speaker (or one way speaker) that reproduces low-frequency, mid-frequency, and high-frequency sounds can be reproduced. The sound resistance member also has an effect of suppressing resonance of the slot causing linear distortion.

Figure 13A:
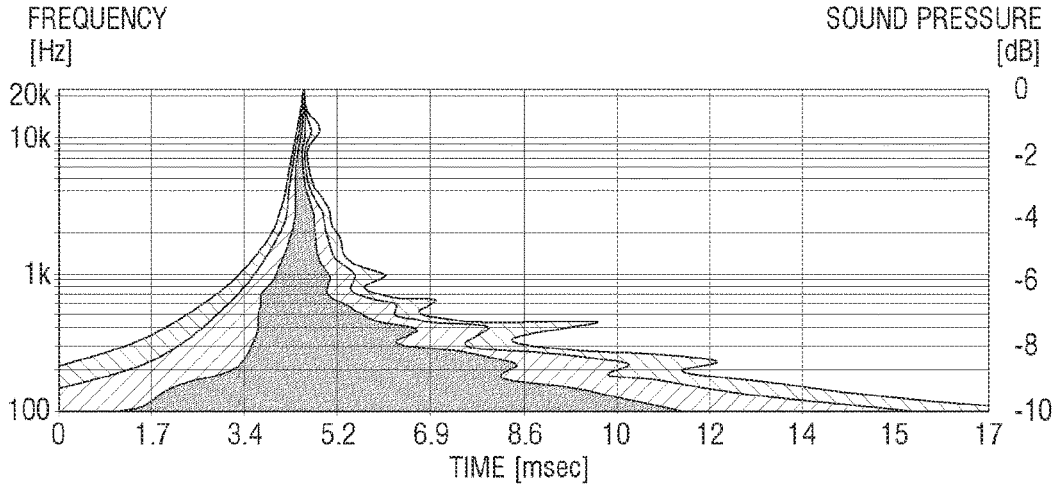
FIG. 13A is a wavelet measurement graph on a time-frequency domain side of a conventional loudspeaker without a slot.
Figure 13B:
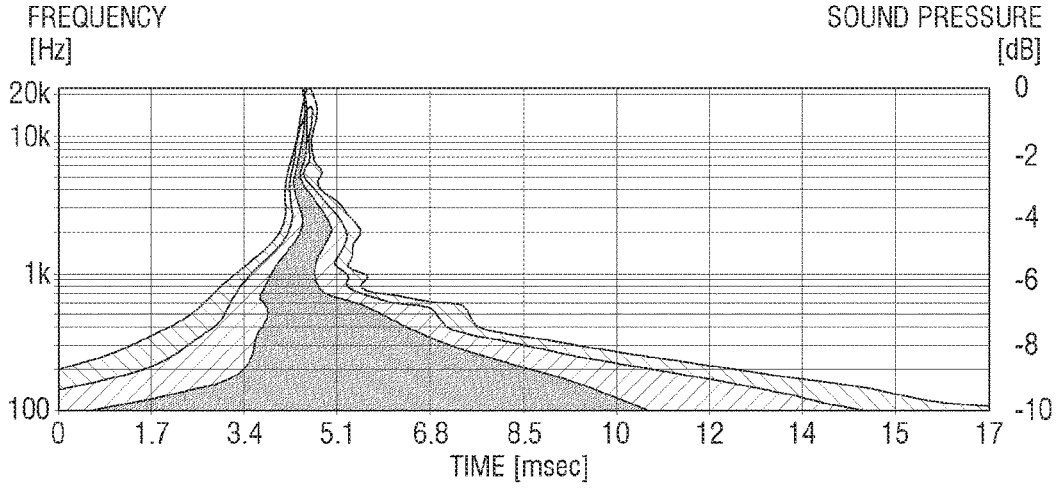
FIG. 13B is a wavelet measurement graph on a time-frequency domain side of a conventional loudspeaker with a slot only.
Figure 13C:
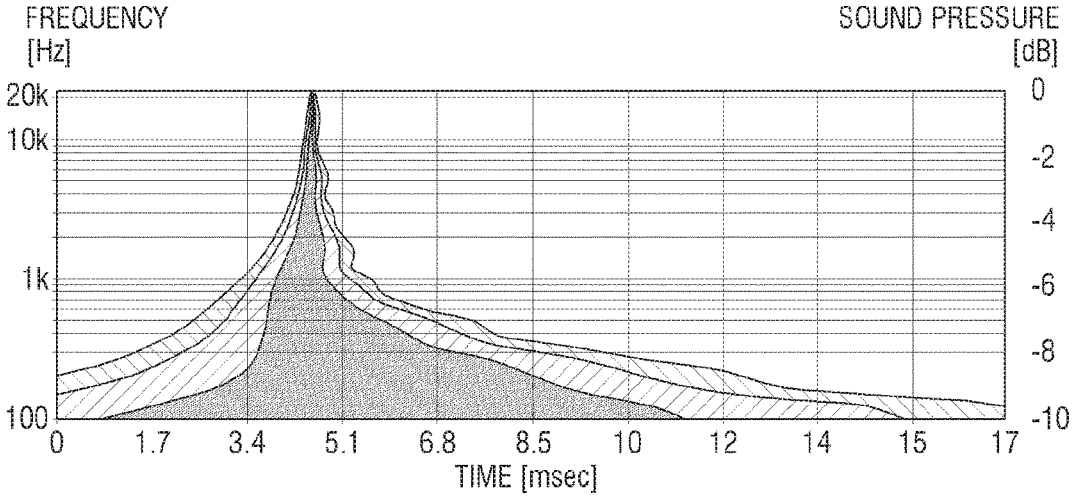
FIG. 13C is a wavelet measurement graph on a time-frequency domain side of a wideband slot-loading loudspeaker with an opening according to an example embodiment of the present disclosure.
Figure 13D:
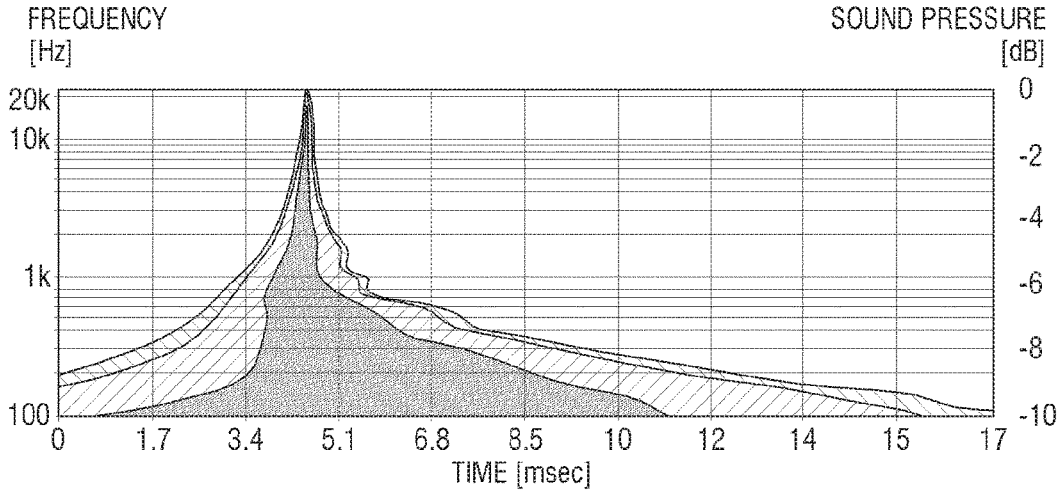
FIG. 13D is a wavelet measurement graph on a time-frequency domain side of a wideband slot-loading loudspeaker with an opening and a sound resistance member according to an example embodiment of the present disclosure.

FIGS. 13A, 13B, 13C and 13D illustrate results of measuring the four types of loudspeakers as described above in terms of a time-frequency complex domain (wavelet). For example, FIG. 13A is a time-frequency complex domain side measurement graph of a conventional loudspeaker without slots without a slot, and FIG. 13B is a time-frequency complex domain side measurement graph of a conventional loudspeaker with a slot only. FIG. 13C is a time-frequency complex domain side measurement graph of a wideband slot-loading loudspeaker according to an embodiment of the present disclosure with an opening, and FIG. 13D is a time-frequency complex domain side measurement graph of a wideband slot-loading loudspeaker according to an embodiment of the present disclosure with an opening and a sound resistance member.

Referring to FIG. 13B, in a slot-loading loudspeaker with a slot only, a group delay occur in the frequency region where peaks and dips are generated, and a spectral hole is generated at about 5 kHz in which the dip occurs in the frequency domain. Here, the group delay may be determined by the fact that the graph is bent in the horizontal direction (time axis) according to the frequency change (vertical axis). Referring to FIGS. 13C and 13D, it can be seen that the group delay and the spectral hole are removed by the opening and the sound resistance member of the wideband slot-loading loudspeaker according to an embodiment of the present disclosure. Therefore, with the wideband slot-loading loudspeaker according to an embodiment of the present disclosure, the performance of the speaker may be improved close to the ideal wavelet shape of a pear shape which is symmetrical to the left and right.

The wideband slot-loading loudspeaker 10 according to an embodiment of the present disclosure as described above may be used as a full-range speaker capable of reproducing all sounds of low, middle, and high frequencies. However, if necessary, the wideband slot-loading loudspeaker 10 according to an embodiment of the present disclosure may be used with a tweeter capable of reproducing a high frequency sound that cannot be reproduced by the wideband slot-loading loudspeaker 10.

Figure 14:
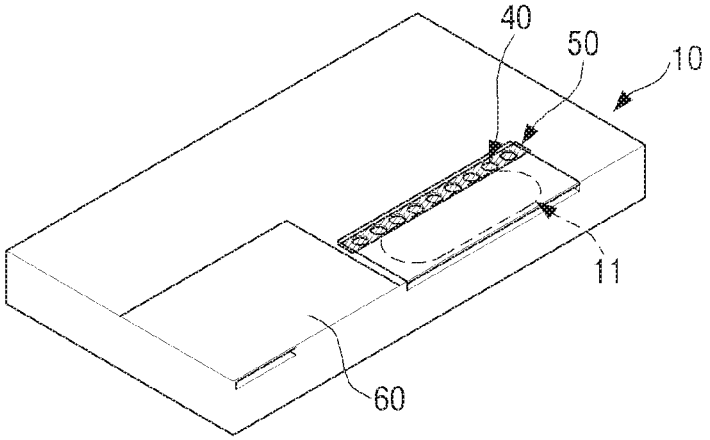
FIG. 14 is a perspective view illustrating an example multi-way speaker system including a wideband slot-loading loudspeaker and a tweeter according to an example embodiment of the present disclosure.

For example, as illustrated in FIG. 14, a multi-way speaker system may be implemented by the wideband slot-loading loudspeaker 10 and a tweeter 60 according to an example embodiment of the present disclosure.

As another example, although not illustrated, a multi-way speaker system may be implemented by using the wideband slot-loading loudspeaker 10 according to an embodiment of the present disclosure as a midrange speaker for reproducing a sound of the middle frequency band, and by separately using a woofer for reproducing a sound of the low frequency band and a tweeter for reproducing a sound of the high frequency band.

Hereinafter, at least one opening 40 used in the wideband slot-loading loudspeaker 10 according to an embodiment of the present disclosure will be described in detail with reference to FIGS. 15A to 17.

The opening 40 of the wideband slot-loading loudspeaker 10 as illustrated in FIG. 4 is formed in a plurality of circular holes 41; however, the shape of the opening 40 is not limited thereto and may be formed in various shapes.

Figure 15A:
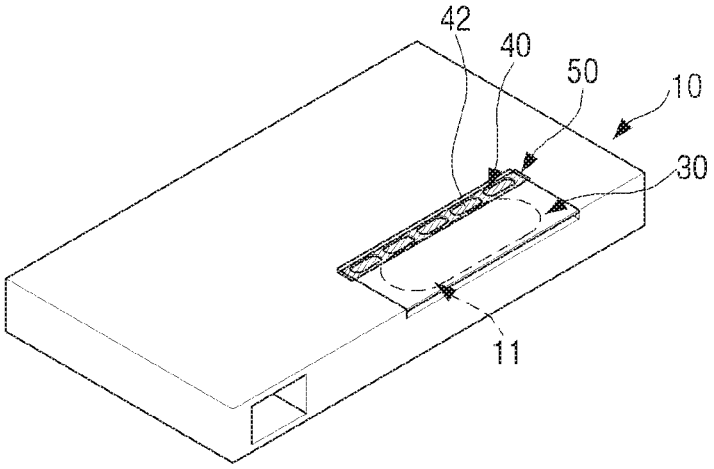
FIG. 15A is a perspective view illustrating an example wideband slot-loading loudspeaker including an opening formed in a plurality of polygons according to an example embodiment of the present disclosure.

For example, as illustrated in FIG. 15A, the opening 40 may be formed by a plurality of elongated holes (or an elliptical shape).

Figure 16A:
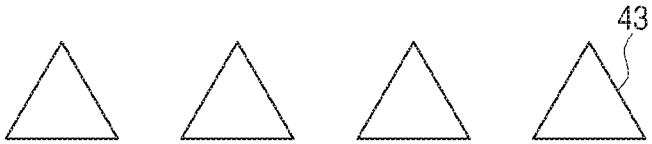
FIGS. 16A, 16B, 16C, 16D and 16E are diagrams illustrating various example shapes of a plurality of holes provided in an opening of a wideband slot-loading loudspeaker according to an example embodiment of the present disclosure.
Figure 16B:
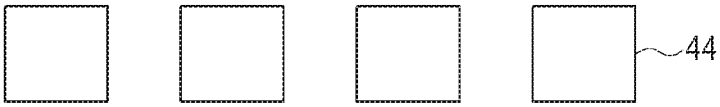
Figure 16C:
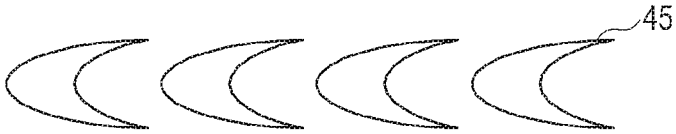
Figure 16D:
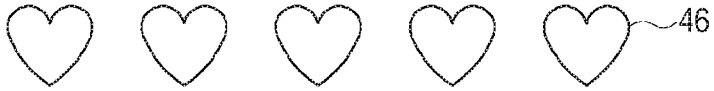
Figure 16E:
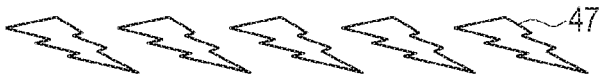

As another example, each of a plurality of holes forming the opening 40 may be formed in a triangular shape 43 as illustrated in FIG. 16A, a rectangular shape 44 as illustrated in FIG. 16B, a crescent shape 45 as illustrated in FIG. 16C, a heart shape 46 as illustrated in FIG. 16D, and a lightning bolt shape 47 as illustrated in FIG. 16E. However, the shape of each of the plurality of holes forming the opening 40 is not limited to the shapes as illustrated in FIGS. 16A to 16E, and may be formed in various shapes not shown. For example, each of the plurality of holes may be formed in a polygon such as a pentagon, a hexagon, or the like, or a combination thereof. Further, the plurality of holes forming the opening 40 may be arranged in a straight line or a curved line.

Figure 15B:
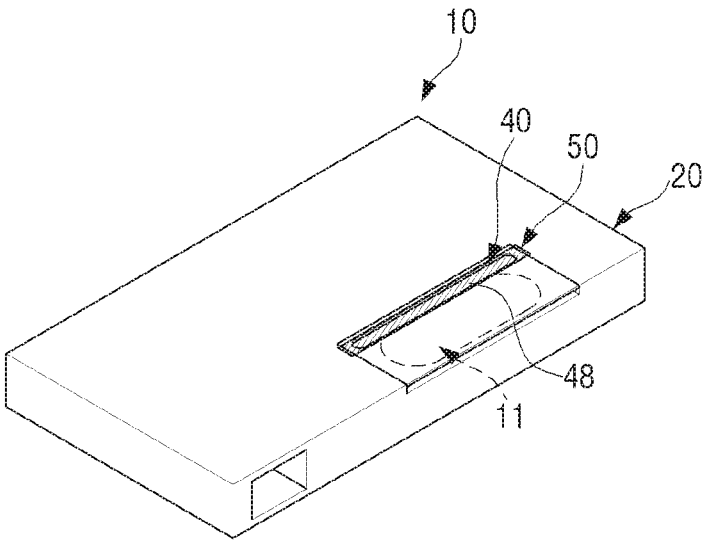
FIG. 15B is a perspective view illustrating an example wideband slot-loading loudspeaker including an opening formed in one slit according to an example embodiment of the present disclosure.

In the above description, the opening 40 is formed in the plurality of holes. However, the opening 40 may be formed in one slit 48 having a length larger than the width as illustrated in FIG. 15B. The length of the slit 48 may be formed to have a length corresponding to the length of one side of the front surface of the speaker driver 11.

Figure 17A:
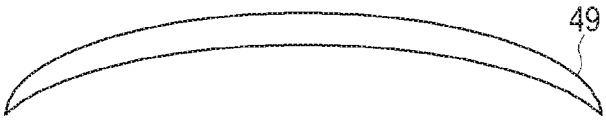
FIGS. 17A, 17B, 17C, 17D and 17E are diagrams illustrating various example shapes of a slit provided in an opening of a wideband slot-loading loudspeaker according to an example embodiment of the present disclosure.
Figure 17B:
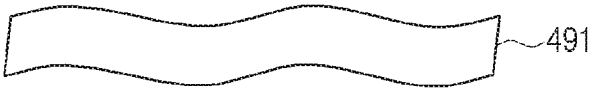

At this time, the shape of the slit 48 is not limited to a rectangular shape as illustrated in FIG. 15B, but may be formed in various shapes. For example, the slit may be formed in an arcuate slit 49 as illustrated in FIG. 17A or a wavy slit 491 as illustrated in FIG. 17B.

Figure 17C:
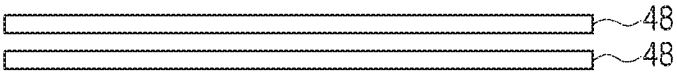
Figure 17D:
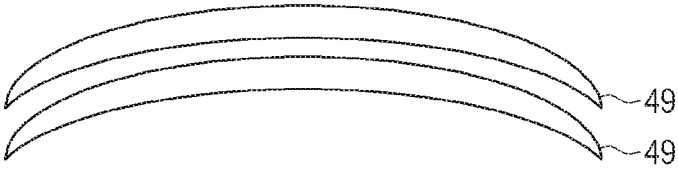
Figure 17E:
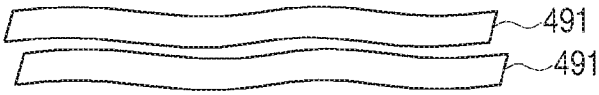

Alternatively, the opening 40 may be formed with two or more slits disposed side by side. For example, the opening 40 may be formed by two rectangular slits 48 as illustrated in FIG. 17C, or the opening 40 may be formed by two arcuate slits 49 as illustrated in FIG. 17D. The opening 40 may be formed by two wavy slits 491 as illustrated in FIG. 17E.

Figure 18A:
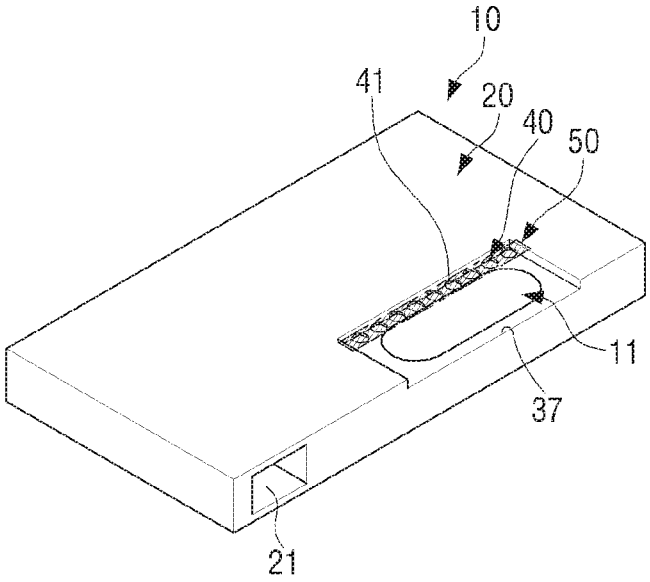
FIG. 18A is a perspective view illustrating an example wideband slot-loading loudspeaker in which a reflective plate is removed according to an example embodiment of the present disclosure.

The wideband slot-loading loudspeaker 10 according to an example embodiment of the present disclosure includes one speaker driver 11 as illustrated in FIG. 18A. However, the number of the speaker drivers 11 is not limited thereto. The wideband slot-loading loudspeaker 10 according to an example embodiment of the present disclosure may include two or more speaker drivers 11. In FIG. 18A, the reflective plate is removed to clearly show the speaker driver 11, and the opening 40 and the sound resistance member 50 provided in the reflective plate are illustrated by imaginary lines.

Figure 18B:
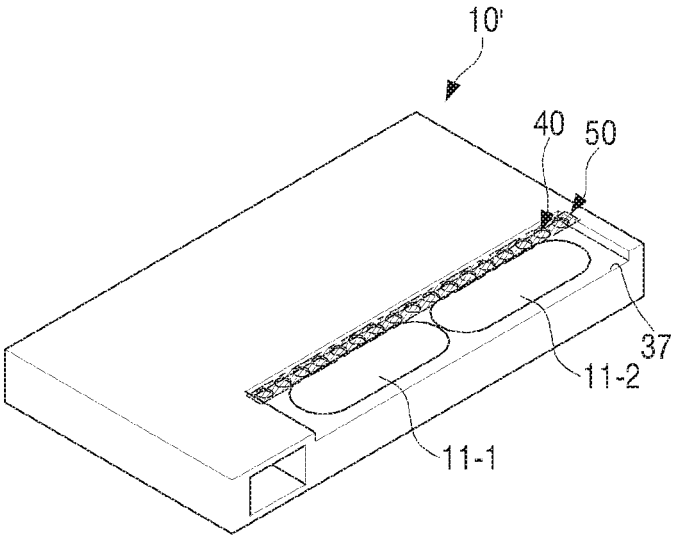
FIGS. 18B and 18C are perspective views illustrating an example wideband slot-loading loudspeaker including two speaker drivers according to an example embodiment of the present disclosure.
Figure 18C:
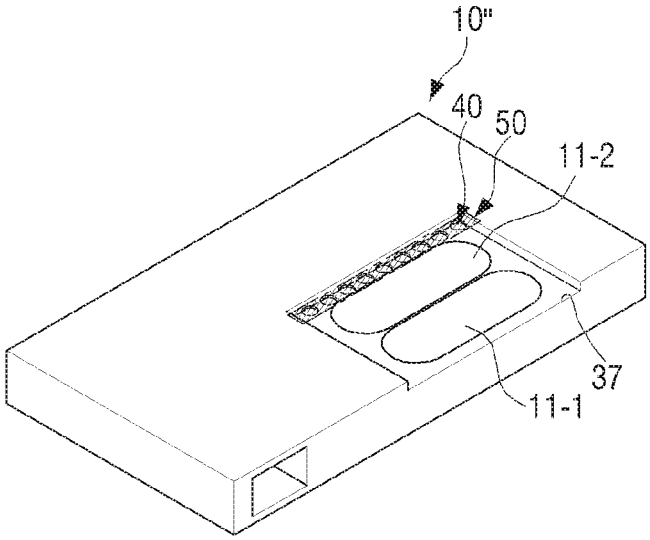

FIGS. 18B and 18C illustrate a wideband slot-loading loudspeaker 10' and 10" according to an example embodiment of the present disclosure including two speaker drivers 11-1 and 11-2. For reference, in FIGS. 18B and 18C, the reflective plate is removed to clearly show the speaker drivers 11-1 and 11-2, and the opening 40 and the sound resistance member 50 provided in the reflective plate are illustrated by imaginary lines.

The two speaker drivers 11-1 and 11-2 may be disposed such that both the speaker drivers 11-1 and 11-2 are adjacent to the acoustic discharge port 37 as illustrated in FIG. 18B. Alternatively, the first speaker driver 11-1 may be disposed adjacent to the acoustic discharge port 37 and the second speaker driver 11-2 may be disposed in a position away from the acoustic discharge port 37 as illustrated in FIG. 18C. In other words, the second speaker driver 11-2 may be disposed adjacent to the opposite side of one side of the first speaker driver 11-1 adjacent to the acoustic discharge port 37.

The wideband slot-loading loudspeaker 10 according to the above-described example embodiment includes the speaker driver 11 having an elliptical shape or a circular track shape. However, the shape of the speaker driver 11 is not limited thereto. The wideband slot-loading loudspeaker 10 according to an embodiment of the present disclosure may include a speaker driver 11 of various shapes.

Figure 19A:
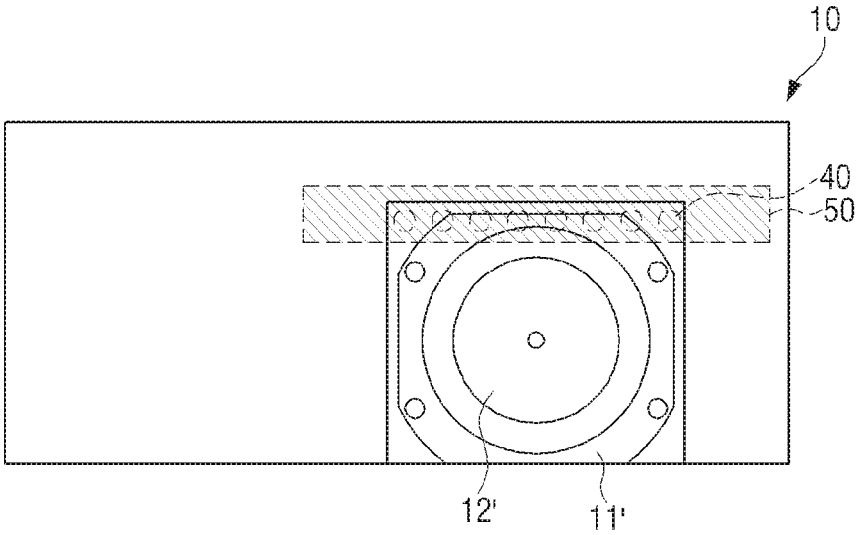
FIGS. 19A and 19B are plan views illustrating example cases where a front surface of a speaker driver of a wideband slot-loading loudspeaker is a circular shape and a square shape, respectively, according to an example embodiment of the present disclosure.

For example, as illustrated in FIG. 19A, the wideband slot-loading loudspeaker 10 according to an embodiment of the present disclosure may include a speaker driver 11' whose front surface shape, that is, the shape of the speaker diaphragm 12' is circular.

Figure 19B:
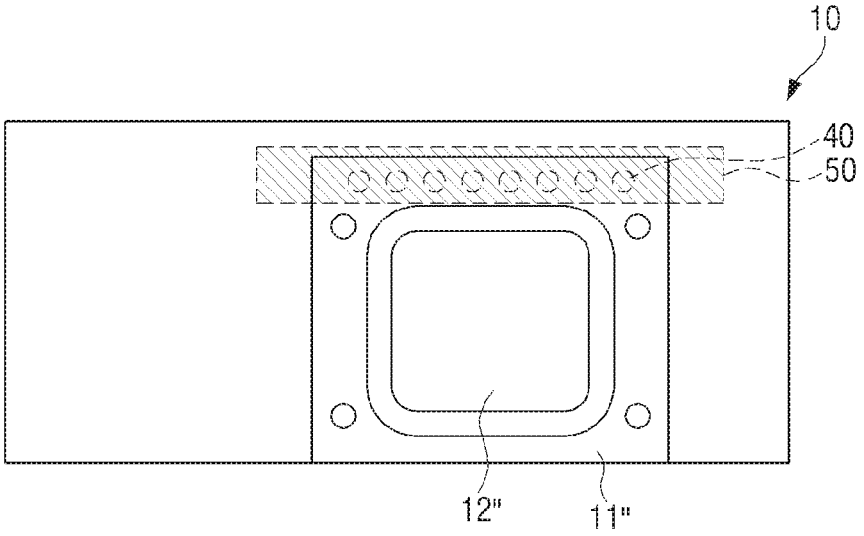

As another example, as illustrated in FIG. 19B, the wideband slot-loading loudspeaker 10 according to an embodiment of the present disclosure may include a speaker driver 11" whose front surface shape, that is, the shape of the speaker diaphragm 12" is substantially square.

At least one opening 40 applied to the wideband slot-loading loudspeaker 10 according to an example embodiment of the present disclosure may be disposed at various positions with respect to the acoustic discharge port 37 of the slot 35.

Hereinafter, a relationship between an opening and an acoustic discharge port in a wideband slot-loading loudspeaker according to an example embodiment of the present disclosure will be described with reference to FIGS. 20A to 23B.

First, the opening 40 may be provided at a position farthest from the acoustic discharge port 37 in the reflective plate 31.

Figure 20A:
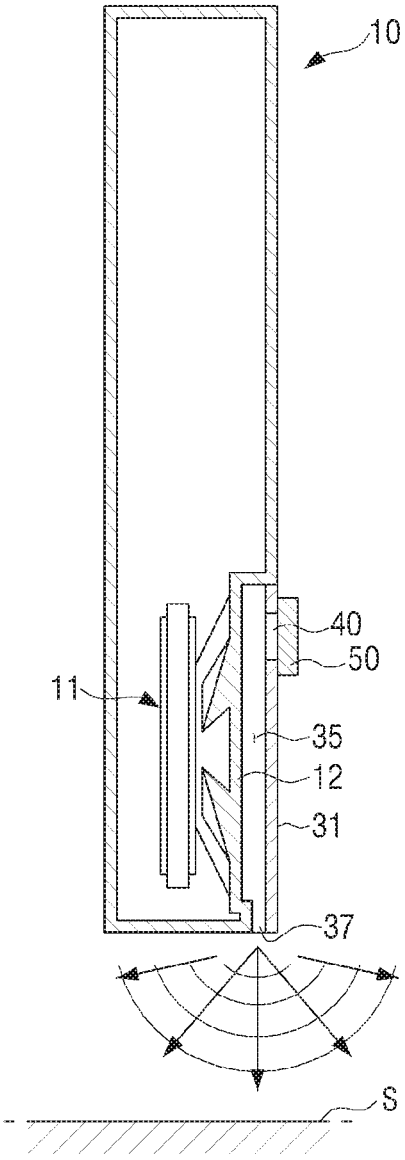
FIGS. 20A, 20B and 20C are cross-sectional views illustrating an example case where an opening is located farthest from an acoustic discharge port in a wideband slot-loading loudspeaker according to an example embodiment of the present disclosure.
Figure 20B:
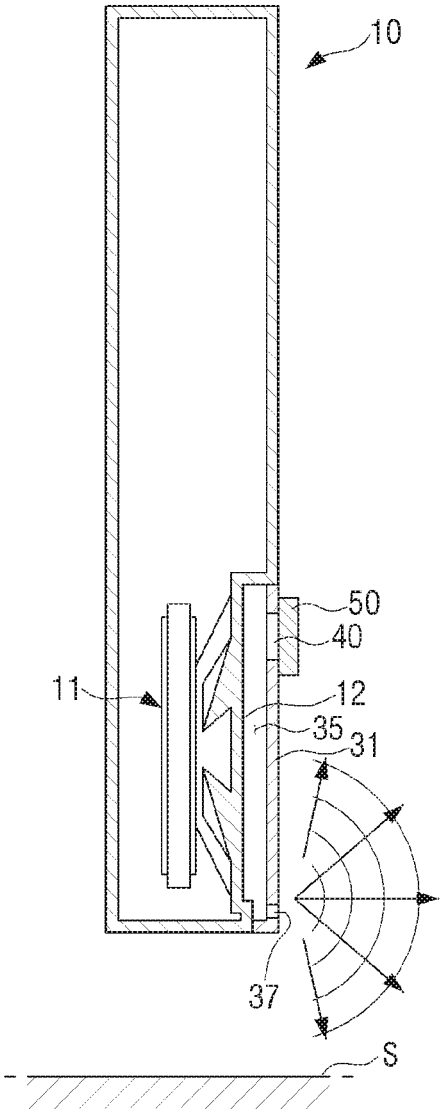
Figure 20C:
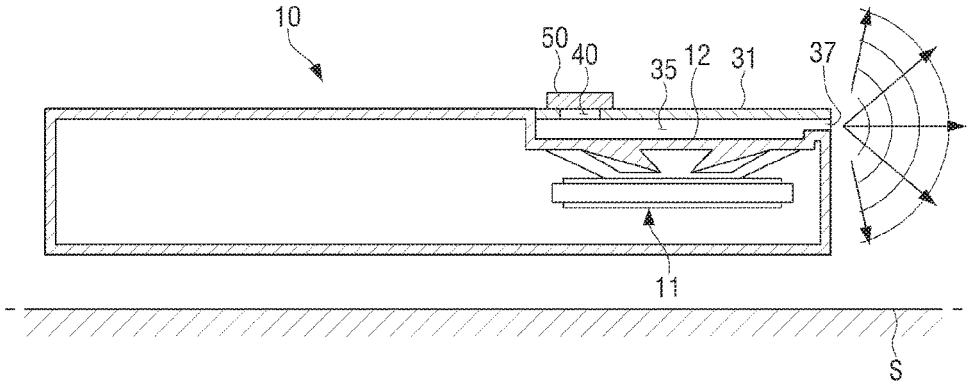

FIGS. 20A, 20B and 20C are cross-sectional views illustrating an example case where the opening 40 is located farthest from the acoustic discharge port 37 in the wideband slot-loading loudspeaker 10 according to an example embodiment of the present disclosure.

In FIG. 20A, the wideband slot-loading loudspeaker 10 is disposed substantially perpendicular to the ground or the support surface S and the acoustic discharge port 37 is formed in a direction substantially parallel to the front surface of the speaker driver 11, that is, a plane extending from the speaker diaphragm 12. Thus, the sound reproduced by the wideband slot-loading loudspeaker 10 is emitted downward. At this time, the opening 40 is provided at a position farthest from the acoustic discharge port 37 in the reflective plate 31. In other words, the opening 40 is provided on the opposite side of the acoustic discharge port 37 in the slot 35. The central axis of the acoustic discharge port 37 and the central axis of the opening 40 are substantially perpendicular to each other.

In FIG. 20B, the wideband slot-loading loudspeaker 10 is disposed substantially perpendicular to the ground or the support surface S and the acoustic discharge port 37 is formed in a direction substantially perpendicular to the front surface of the speaker driver 11, that is, the plane extending from the speaker diaphragm 12. Thus, the sound reproduced by the wideband slot-loading loudspeaker 10 is emitted forward. At this time, the opening 40 is provided at the position farthest from the acoustic discharge port 37 in the reflective plate 31. In other words, the opening 40 is provided on the opposite side of the acoustic discharge port 37 in the slot 35. The central axis of the acoustic discharge port 37 and the central axis of the opening 40 are substantially parallel to each other.

In FIG. 20C, the wideband slot-loading loudspeaker 10 is disposed substantially parallel to the ground or the support surface S and the acoustic discharge port 37 is formed in a direction substantially parallel to the front surface of the speaker driver 11, that is, the plane extending from the speaker diaphragm 12. Thus, the sound reproduced by the wideband slot-loading loudspeaker 10 is emitted forward. At this time, the opening 40 is provided at the position farthest from the acoustic discharge port 37 in the reflective plate 31. In other words, the opening 40 is provided on the opposite side of the acoustic discharge port 37 in the slot 35. The central axis of the acoustic discharge port 37 and the central axis of the opening 40 are substantially perpendicular to each other. The wideband slot-loading loudspeaker 10 of FIG. 20C is the same as the wideband slot-loading loudspeaker 10 of FIG. 20A, which is arranged in a substantially horizontal position relative to the ground or the support surface S.

Next, the opening 40 may be provided at the nearest position from the acoustic discharge port 37 in the reflective plate 31.

Figure 21A:
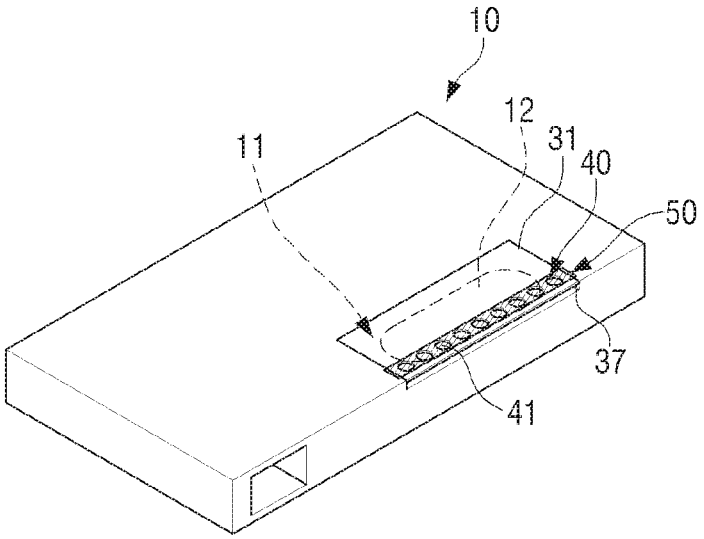
FIGS. 21A, 21B and 21C are diagrams illustrating an example case where an opening is located closest to an acoustic discharge port in a wideband slot-loading loudspeaker according to an example embodiment of the present disclosure.
Figure 21B:
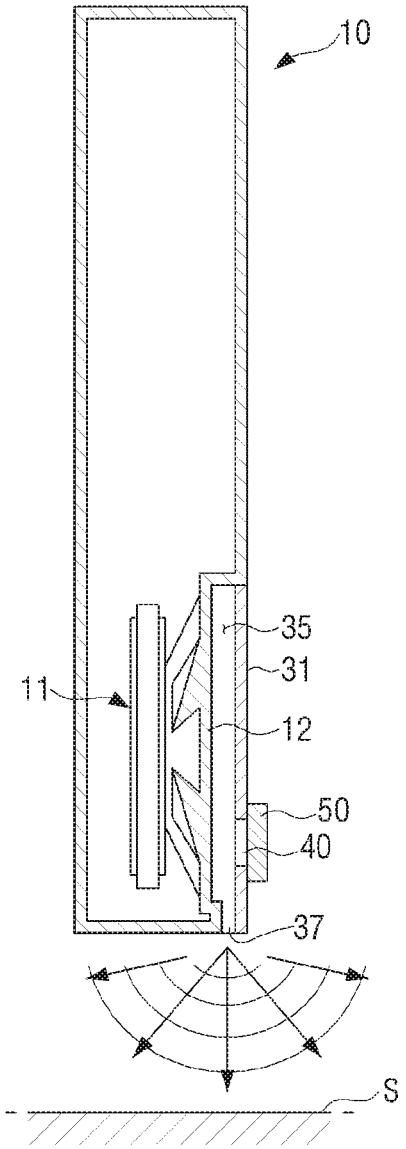
Figure 21C:
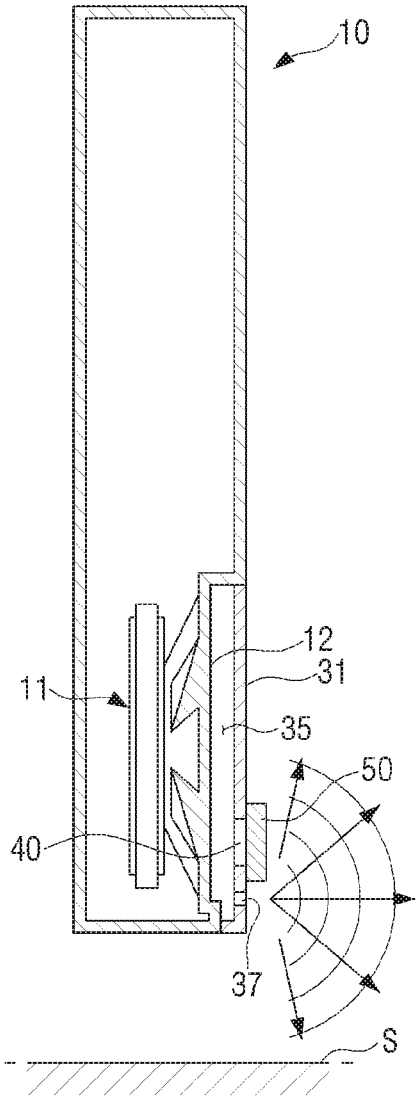

FIGS. 21A, 21B and 21C are views illustrating an example case where an opening is located closest to an acoustic discharge port in a wideband slot-loading loudspeaker according to an example embodiment of the present disclosure.

FIG. 21A is a perspective view illustrating a wideband slot-loading loudspeaker 10 according to an embodiment of the present disclosure in which the opening 40 is positioned closest to the acoustic discharge port 37.

Referring to FIG. 21A, a plurality of holes 41 forming the opening 40 is provided in the reflective plate 31 adjacent to and parallel to the acoustic discharge port 37. In other words, the opening 40 is provided adjacent to one end of the reflective plate 31. The opening 40 is covered with the sound resistance member 50. Therefore, the sound emitted through the opening 40 passes through the sound resistance member 50. In FIG. 21A, the sound resistance member 50 is provided on the upper side of the opening 40, but the sound resistance member 50 may be provided inside the opening 40. The acoustic discharge port 37 is provided in a direction substantially parallel to the front surface of the speaker driver 11, that is, a plane extending from the speaker diaphragm 12. Thus, the sound reproduced by the wideband slot-loading loudspeaker 10, which is arranged substantially parallel to the support surface, is emitted forward.

In FIG. 21B, the wideband slot-loading loudspeaker 10 is disposed substantially perpendicular to the ground or the support surface S and the acoustic discharge port 37 is formed in a direction substantially parallel to the front surface of the speaker driver 11, that is, a plane extending from the speaker diaphragm 12. Thus, the sound reproduced by the wideband slot-loading loudspeaker 10 is emitted downward. At this time, the opening 40 is provided at the position closest to the acoustic discharge port 37 in the reflective plate 31. In other words, the opening 40 is provided in the slot 35 to be adjacent to the acoustic discharge port 37. The central axis of the acoustic discharge port 37 and the central axis of the opening 40 are substantially perpendicular to each other. The wideband slot-loading loudspeaker 10 of FIG. 21B is the same as the wideband slot-loading loudspeaker 10 of FIG. 21A, which is arranged substantially perpendicular to the ground or the support surface S.

In FIG. 21C, the wideband slot-loading loudspeaker 10 is disposed substantially perpendicular to the ground or the support surface S and the acoustic discharge port 37 is formed in a direction substantially perpendicular to the front surface of the speaker driver 11, that is, the plane extending from the speaker diaphragm 12. Thus, the sound reproduced by the wideband slot-loading loudspeaker 10 is emitted forward. At this time, the opening 40 is provided at the position closest to the acoustic discharge port 37 in the reflective plate 31. In other words, the opening 40 is provided in the slot 35 to be adjacent to the acoustic discharge port 37. The central axis of the acoustic discharge port 37 and the central axis of the opening 40 are substantially parallel to each other.

Next, the opening 40 may be provided in the middle portion of the reflective plate 31, that is, in the middle of the slot 35.

Figure 22A:
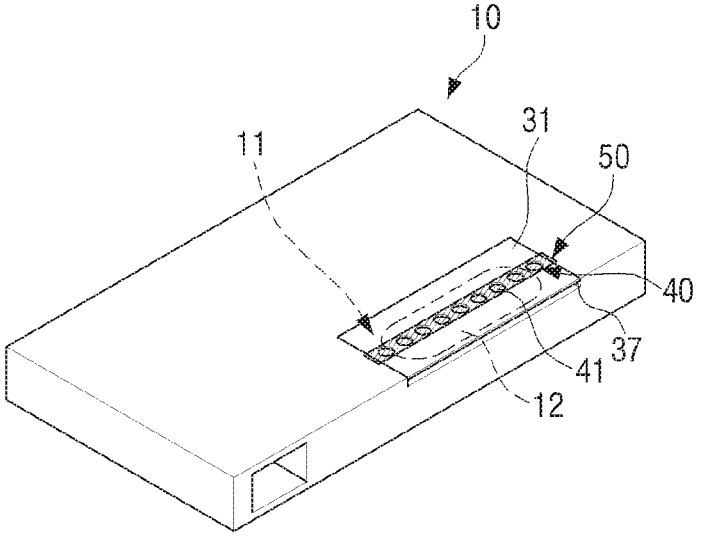
FIGS. 22A, 22B and 22C are diagrams illustrating an example case where an opening is located at the middle of a reflective plate in a wideband slot-loading loudspeaker according to an example embodiment of the present disclosure.
Figure 22B:
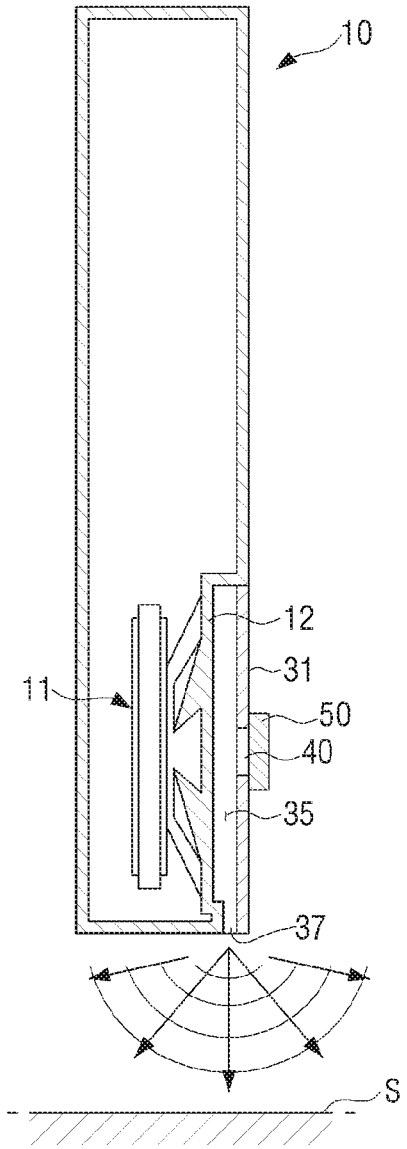
Figure 22C:
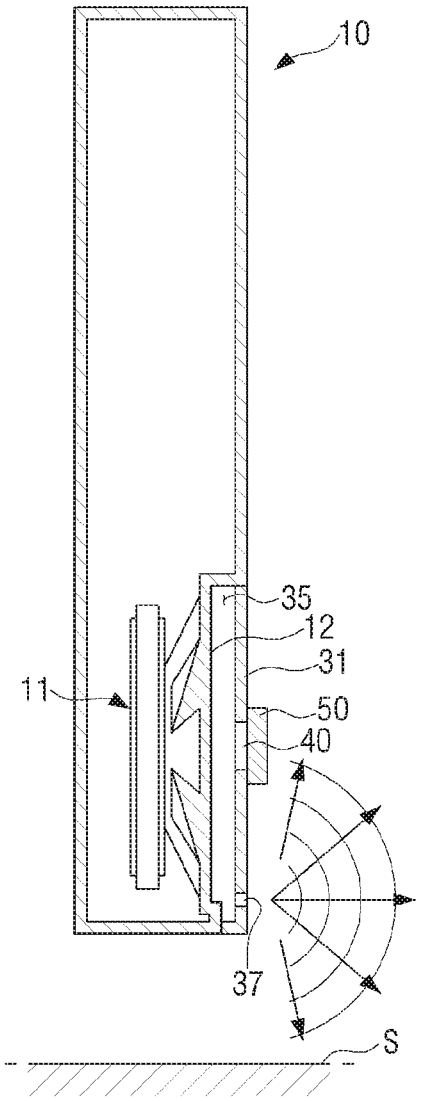

FIGS. 22A, 22B and 22C are views illustrating an example case where an opening is located in a middle portion of a reflecting plate in a wideband slot-loading loudspeaker according to an example embodiment of the present disclosure.

FIG. 22A is a perspective view illustrating a wideband slot-loading loudspeaker 10 according to an embodiment of the present disclosure in which the opening 40 is positioned in the middle of the reflective plate 31.

Referring to FIG. 22A, a plurality of holes 41 forming the opening 40 is provided substantially parallel to the acoustic discharge port 37 in the middle of the reflective plate 31. In other words, the opening 40 is provided in the middle of the slot 35 formed by the reflective plate 31 to be substantially parallel to the acoustic discharge port 37. The opening 40 is covered with the sound resistance member 50. Therefore, the sound emitted through the opening 40 passes through the sound resistance member 50. The acoustic discharge port 37 is provided in a direction substantially parallel to the front surface of the speaker driver 11, that is, the plane extending from the speaker diaphragm 12. Thus, the sound reproduced by the wideband slot-loading loudspeaker 10, which is arranged substantially parallel to the ground or the support surface S, is emitted forward.

In FIG. 22B, the wideband slot-loading loudspeaker 10 is disposed substantially perpendicular to the ground or the support surface S and the acoustic discharge port 37 is formed in a direction substantially parallel to the front surface of the speaker driver 11, that is, the plane extending from the speaker diaphragm 12. Thus, the sound reproduced by the wideband slot-loading loudspeaker 10 is emitted downward. At this time, the opening 40 is provided in the middle of the reflective plate 31 substantially parallel to the acoustic discharge port 37. In other words, the opening 40 is provided in the middle of the slot 35 in the depth direction of the slot 35, substantially parallel to the acoustic discharge port 37. The central axis of the acoustic discharge port 37 and the central axis of the opening 40 are substantially perpendicular to each other. The wideband slot-loading loudspeaker 10 of FIG. 22B is the same as the wideband slot-loading loudspeaker 10 of FIG. 22A, which is arranged substantially perpendicular to the ground or the support surface S.

In FIG. 22C, the wideband slot-loading loudspeaker 10 is disposed substantially perpendicular to the ground or the support surface S and the acoustic discharge port 37 is formed in a direction substantially perpendicular to the front surface of the speaker driver 11, that is, the plane extending from the speaker diaphragm 12. Thus, the sound reproduced by the wideband slot-loading loudspeaker 10 is emitted forward. At this time, the opening 40 is provided in the middle of the reflective plate 31 substantially parallel to the acoustic discharge port 37. In other words, the opening 40 is provided in the middle of the slot 35 in the depth direction of the slot 35, substantially parallel to the acoustic discharge port 37. The central axis of the acoustic discharge port 37 and the central axis of the opening 40 are substantially parallel to each other.

In the above description, the opening 40 is arranged in substantially parallel with one end of the reflective member 30 under which the acoustic discharge port 37 is provided. However, the arrangement of the opening 40 is not limited thereto. The opening 40 may be inclined or arbitrarily arranged with respect to one end of the reflective member 30 in which the acoustic discharge port 37 is provided.

Figure 23A:
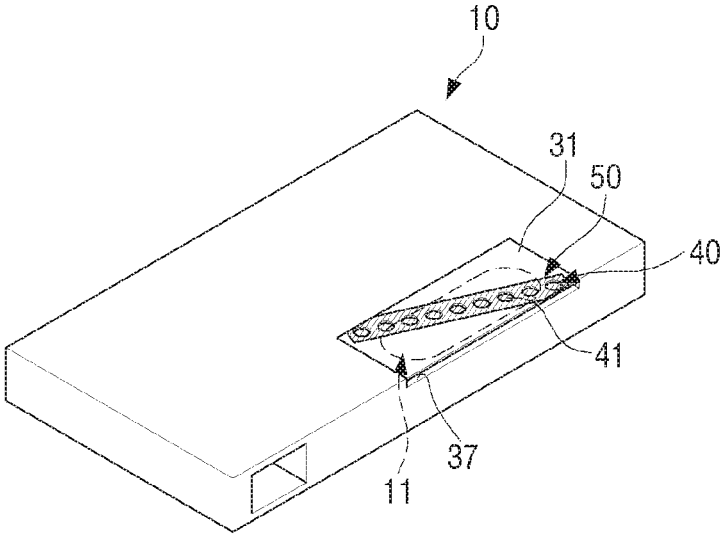
FIG. 23A is a perspective view illustrating an example case where an opening of a wideband slot-loading loudspeaker is inclined with respect to an acoustic discharge port according to an example embodiment of the present disclosure.

FIG. 23A is a perspective view illustrating an example case where an opening of a wideband slot-loading loudspeaker is inclined with respect to one end of a reflective member in which an acoustic discharge port is provided according to an example embodiment of the present disclosure.

Referring to FIG. 23A, the plurality of holes 41 forming the opening 40 is provided in the reflective plate 31 to form a predetermined angle with one end of the reflective plate 31 under which the acoustic discharge port 37 is provided. In other words, the opening 40 is provided in the reflective plate 31 and forms an acute angle with the one end of the reflective plate 31 at which the acoustic discharge port 37 is provided. At this time, the opening 40 may be formed in the diagonal direction of the reflective plate 31. The opening 40 is covered with the sound resistance member 50. Therefore, the sound emitted through the opening 40 passes through the sound resistance member 50. The acoustic discharge port 37 is provided in a direction substantially parallel to the speaker diaphragm 12 of the speaker driver 11. Thus, the sound reproduced by the wideband slot-loading loudspeaker 10, which is arranged substantially parallel to the ground or the support surface S, is emitted forward.

Figure 23B:
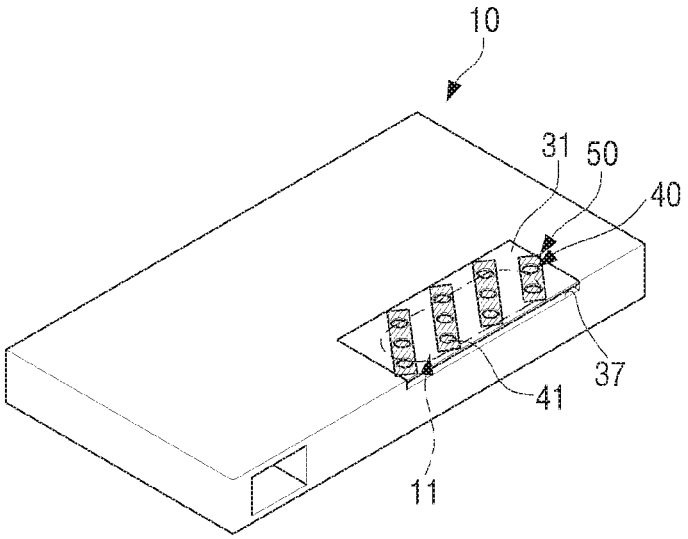
FIG. 23B is a perspective view illustrating an example case where a plurality of through holes of an opening of a wideband slot-loading loudspeaker is arbitrarily provided in a reflective plate according to an example embodiment of the present disclosure.

FIG. 23A illustrates an example case where the plurality of holes 41 forming the opening 40 is arranged in a straight line. However, the arrangement of the plurality of holes 41 forming the opening 40 is not limited thereto. For example, the plurality of holes 41 forming the opening 40 may be formed in the reflective plate 31 in an arbitrary arrangement as illustrated in FIG. 23B. At this time, the sound resistance member 50 covering the opening 40 is also arbitrarily arranged to cover the plurality of holes 41. FIG. 23B is a perspective view illustrating an example case where a plurality of holes comprising an opening of a wideband slot-loading loudspeaker is arbitrarily arranged in a reflective plate according to an example embodiment of the present disclosure.

In the above description, the speaker driver 11 of the wideband slot-loading loudspeaker 10 according to an embodiment of the present disclosure is provided in the longitudinal direction, that is, in the direction of the long axis of the speaker driver 11 (the direction of arrow A in FIG. 24) with respect to the acoustic discharge port 37. However, the arrangement of the speaker driver 11 is not limited thereto.

Figure 24:
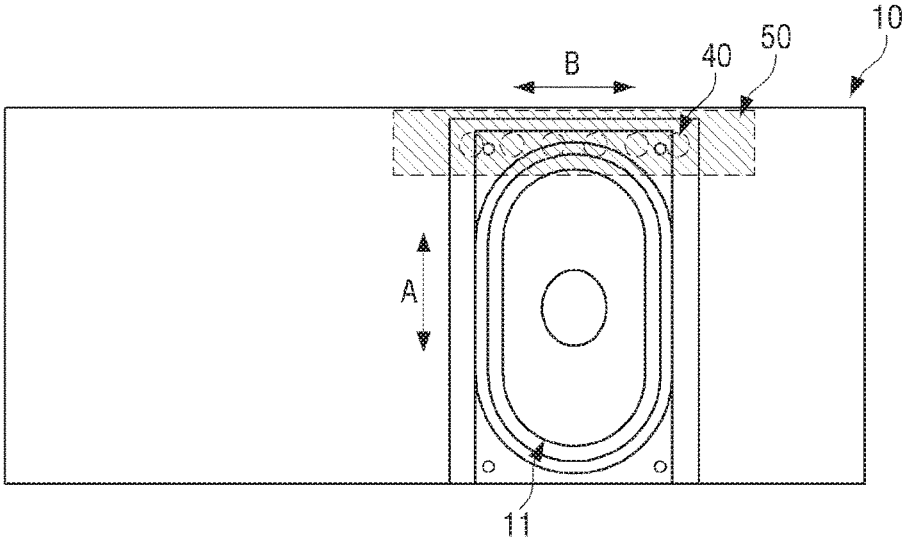
FIG. 24 is a plan view illustrating an example case where an opening of a wideband slot-loading loudspeaker is provided in the direction of the short axis of a speaker driver according to an example embodiment of the present disclosure.

For example, as illustrated in FIG. 24, the speaker driver 11 of the wideband slot-loading loudspeaker 10 may be provided in the width direction, that is, in the direction of the short axis of the speaker driver 11 (the direction of arrow B) with respect to the acoustic discharge port 37. At this time, the opening 40 provided in the reflective member 30 may be formed in parallel with the acoustic discharge port 37 as illustrated in FIG. 24. In other words, the opening 40 may be provided parallel to the direction of the short axis (the direction of arrow B) of the speaker driver 11. Here, FIG. 24 is a plan view illustrating an example case where the opening 40 of the wideband slot-loading loudspeaker 10 according to an example embodiment of the present disclosure is provided in the direction of the short axis (the direction of arrow B) of a speaker driver 11. For reference, in FIG. 24, the reflective plate is removed to clearly show the speaker driver 11.

The wideband slot-loading loudspeaker 10 according to an example embodiment of the present disclosure may be disposed in an electronic device such as an image display apparatus, a mobile device, or the like.

Hereinafter, a method of arranging a wideband slot-loading loudspeaker according to an embodiment of the present disclosure in an image display apparatus will be described with reference to FIGS. 25A to 26C. For reference, in FIGS. 25A and 26C, a slim flat television is illustrated as an example of an image display apparatus.

Figure 25A:
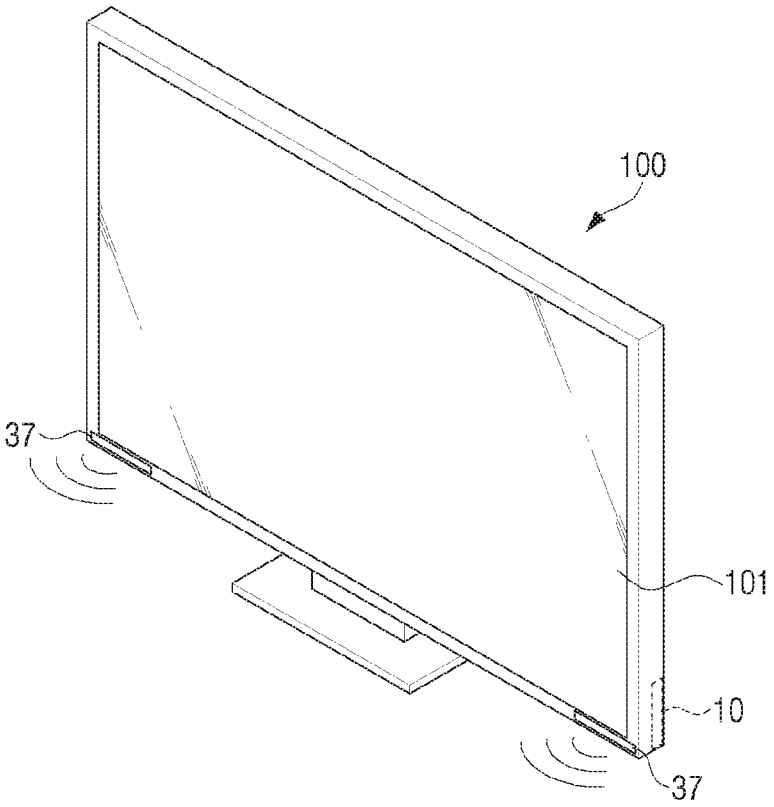
FIGS. 25A, 25B and 25C are perspective views illustrating a television provided with example wideband slot-loading loudspeakers according to an example embodiment of the present disclosure.

FIG. 25A is a diagram illustrating an example case in which two wideband slot-loading loudspeakers 10 according to an example embodiment of the present disclosure are disposed at the lower end of a television 100. For example, the two wideband slot-loading loudspeakers 10 are disposed behind the lower end portion of a display 101, so they are not visible in front of the television 100.

At this time, the acoustic discharge port 37 of the wideband slot-loading loudspeaker 10 is formed on the front surface of the lower end of the television 100. Thus, the sound reproduced by the wideband slot-loading loudspeaker 10 passes through the slot 35 and is emitted toward the front of the television 100 through the acoustic discharge port 37 at the lower end of the television 100.

As another example, when the acoustic discharge port 37 provided in the slot 35 of the wideband slot-loading loudspeaker 10 cannot be directly exposed to the front surface of the lower end of the television 100, a waveguide (not illustrated) may be provided in front of the acoustic discharge port 37. Then, the sound reproduced by the wideband slot-loading loudspeaker 10 may be emitted toward the front of the television 100 through the acoustic discharge port 37 and the waveguide.

As another example, although not illustrated, the acoustic discharge port 37 of the wideband slot-loading loudspeaker 10 may be provided on the bottom surface of the lower end of the television 100. In this case, the sound reproduced by the wideband slot-loading loudspeaker 10 is emitted toward the bottom, that is, the ground or the support surface on which the television 100 is disposed.

Figure 25B:
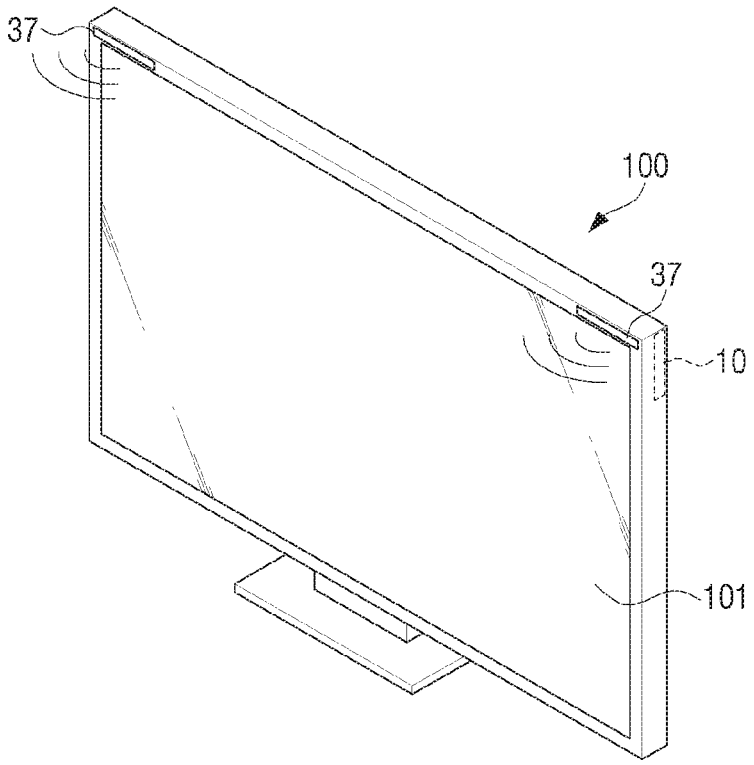

FIG. 25B is a perspective view illustrating a television 100 having two wideband slot-loading loudspeakers 10 according to an example embodiment of the present disclosure which are provided at the upper end of the television 100. At this time, since the two wideband slot-loading loudspeakers 10 are disposed behind the upper end portion of a display 101, they are not visible in front of the television 100.

Referring to FIG. 25B, the acoustic discharge ports 37 of the wideband slot-loading loudspeakers 10 are formed on the front surface of the upper end of the television 100. Thus, the sound reproduced by the wideband slot-loading loudspeakers 10 is emitted toward the front of the television 100 through the acoustic discharge ports 37 at the upper end of the television 100.

As another example, although not illustrated, the acoustic discharge ports 37 of the wideband slot-loading loudspeakers 10 may be provided on the top surface of the upper end of the television 100. In this case, the sound reproduced by the wideband slot-loading loudspeakers 10 is emitted above the television 100 through the acoustic discharge ports 37 on the upper end of the television 100.

Figure 25C:
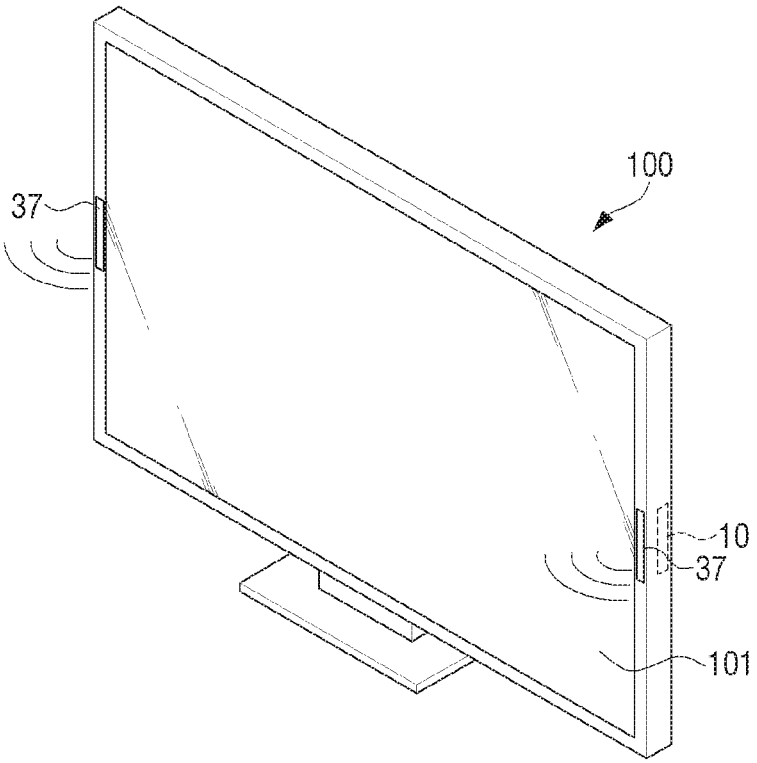

FIG. 25C is a perspective view illustrating a television 100 in which two wideband slot-loading loudspeakers 10 according to an example embodiment of the present disclosure are disposed on both side ends. At this time, since the two wideband slot-loading loudspeakers 10 are disposed behind both side end portions of a display 101, they are not visible in front of the television 100.

Referring to FIG. 25C, the acoustic discharge ports 37 of the wideband slot-loading loudspeakers 10 are formed on the front surfaces of the both side ends of the television 100. Thus, the sound reproduced by the wideband slot-loading loudspeakers 10 is emitted toward the front of the television 100 through the acoustic discharge ports 37 at the both side ends of the television 100.

As another example, although not illustrated, the acoustic discharge port 37 of the wideband slot-loading loudspeaker 10 may be provided on the side surface of each of the both side ends of the television 100. In this case, the sound reproduced by the wideband slot-loading loudspeakers 10 is emitted toward both sides of the television 100 through the acoustic discharge ports 37 at the both side ends of the television 100.

The above-described television 100 as illustrated in FIGS. 25A to 25C includes two wideband slot-loading loudspeakers 10. However, the number of the wideband slot-loading loudspeakers 10 provided in the television 100 is not limited thereto. As an example, four or more wideband slot-loading loudspeakers 10 may be disposed in the television 100.

Figure 26A:
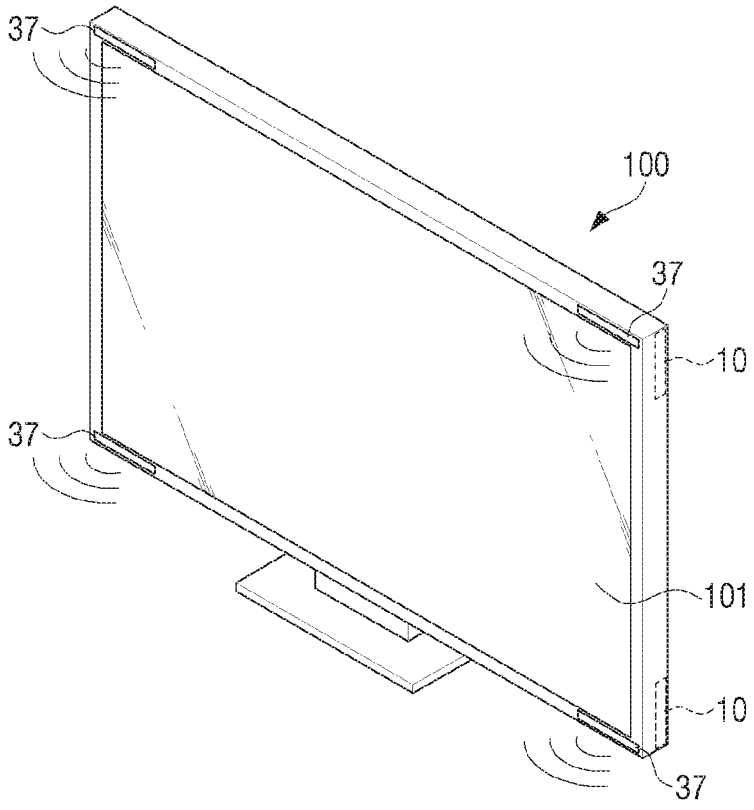
FIGS. 26A, 26B and 26C are perspective views illustrating a television provided with example wideband slot-loading loudspeakers according to an example embodiment of the present disclosure.

For example, as illustrated in FIG. 26A, four wideband slot-loading loudspeakers 10 according to an embodiment of the present disclosure may be disposed at the upper end and the lower end of the television 100. At this time, since two wideband slot-loading loudspeakers 10 are disposed behind the upper end portion of a display 101 and two wideband slot-loading loudspeakers 10 are disposed behind the lower end portion of the display 101, they are not visible in front of the television 100.

Referring to FIG. 26A, the acoustic discharge ports 37 of the four wideband slot-loading loudspeakers 10 are formed on the front surfaces of the upper and lower ends of the television 100. Thus, the sound reproduced by the four wideband slot-loading loudspeakers 10 is emitted toward the front of the television 100 through the acoustic discharge ports 37 at the upper and lower ends of the television 100.

As another example, although not illustrated, the acoustic discharge ports 37 of the four wideband slot-loading loudspeaker 10 may be provided on the top surface of the upper end and the bottom surface of the lower end of the television 100. In this case, the sound reproduced by the two wideband slot-loading loudspeakers 10 disposed at the upper end of the television 100 is emitted above the television 100 through the acoustic discharge port 37 at the upper end of the television 100, and the sound reproduced by the two wideband slot-loading loudspeakers 10 disposed at the lower end of the television 100 is emitted toward the bottom, that is, the ground or the support surface through the acoustic discharge ports 37 at the lower end of the television 100.

Alternatively, although not illustrated, the acoustic discharge ports 37 of the two wideband slot-loading loudspeaker 10 disposed in the upper end of the television 100 may be provided on the top surface of the upper end of the television 100, and the acoustic discharge ports 37 of the two wideband slot-loading loudspeaker 10 disposed in the lower end of the television 100 may be provided on the front surface of the lower end of the television 100. In this case, the sound reproduced by the two wideband slot-loading loudspeakers 10 disposed in the upper end of the television 100 is emitted above the television 100 through the acoustic discharge port 37 on the upper end of the television 100, and the sound reproduced by the two wideband slot-loading loudspeakers 10 is emitted forward through the acoustic discharge ports 37 at the lower end of the television 100.

Alternatively, although not illustrated, the acoustic discharge ports 37 of the two wideband slot-loading loudspeakers 10 disposed in the upper end of the television 100 may be provided on the front surface of the upper end of the television 100, and the acoustic discharge ports 37 of the two wideband slot-loading loudspeakers 10 disposed in the lower end of the television 100 may be provided on the bottom surface of the lower end of the television 100. In this case, the sound reproduced by the two wideband slot-loading loudspeakers 10 disposed in the upper end of the television 100 is emitted toward the front of the television 100 through the acoustic discharge port 37 on the upper end of the television 100, and the sound reproduced by the two wideband slot-loading loudspeakers 10 disposed in the lower end of the television 100 is emitted toward the bottom through the acoustic discharge ports 37 on the lower end of the television 100.

Figure 26B:
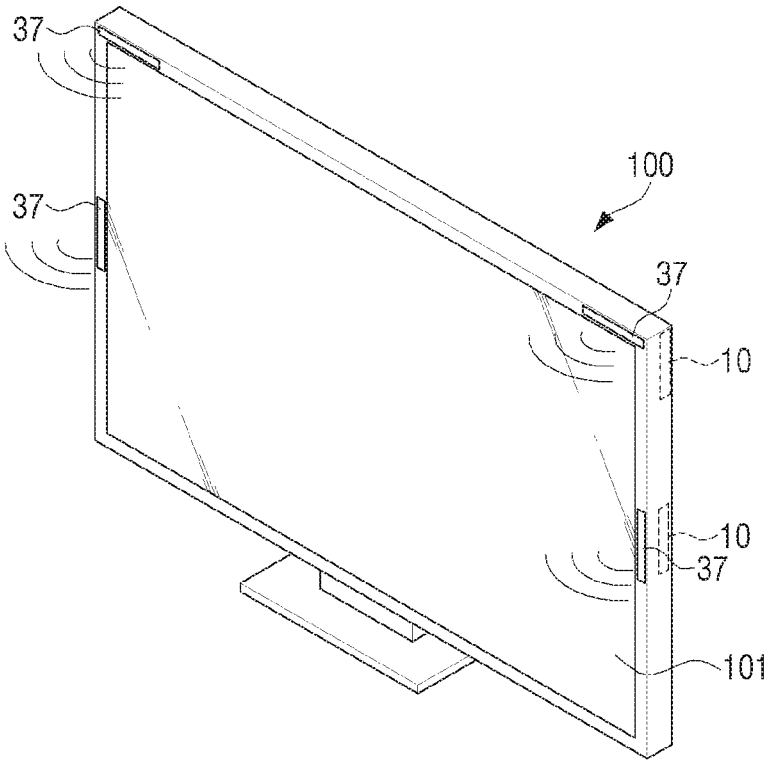

FIG. 26B illustrates an example case in which four wideband slot-loading loudspeakers 10 according to an example embodiment of the present disclosure are disposed at the upper end and both side ends of the television 100. At this time, since two wideband slot-loading loudspeakers 10 are disposed behind the upper end portion of a display 101 and two wideband slot-loading loudspeakers 10 are disposed behind the both side end portions of the display 101, they are not visible in front of the television 100.

Referring to FIG. 26B, the acoustic discharge ports 37 of the four wideband slot-loading loudspeakers 10 are formed on the front surfaces of the upper and both side ends of the television 100. Thus, the sound reproduced by the four wideband slot-loading loudspeakers 10 is emitted toward the front of the television 100 through the acoustic discharge ports 37 at the upper and both side ends of the television 100.

As another example, although not illustrated, the acoustic discharge ports 37 of the four wideband slot-loading loudspeaker 10 may be provided on the top surface of the upper end and the side surfaces of the both side ends of the television 100. In this case, the sound reproduced by the wideband slot-loading loudspeakers 10 is emitted above and to both sides of the television 100.

Figure 26C:
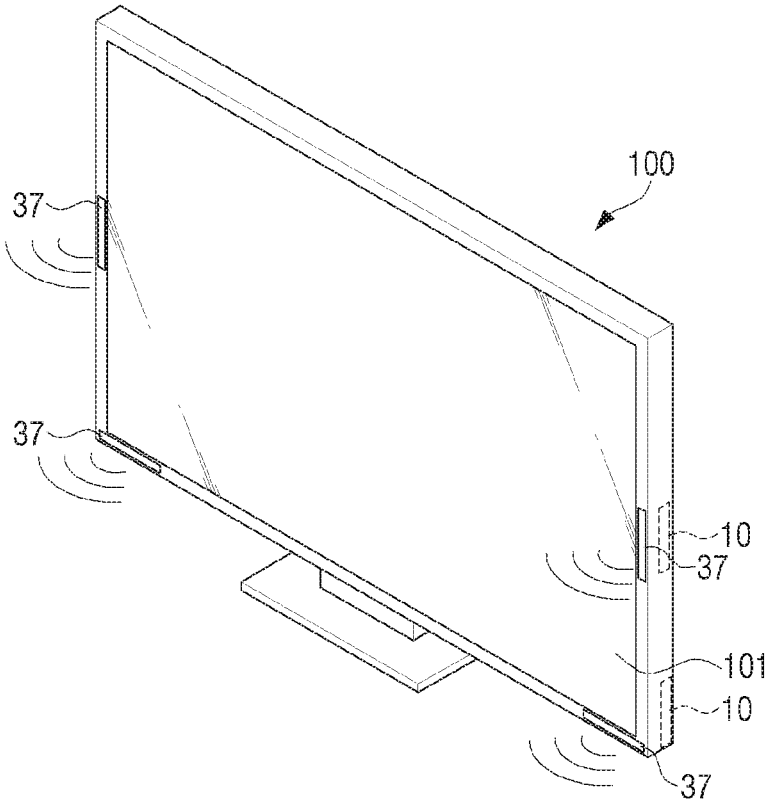

FIG. 26C illustrates an example case in which four wideband slot-loading loudspeakers 10 according to an example embodiment of the present disclosure are disposed at the lower end and both side ends of the television 100. At this time, since two wideband slot-loading loudspeakers 10 are disposed behind the lower end portion of a display 101 and two wideband slot-loading loudspeakers 10 are disposed behind the both side end portions of the display 101, they are not visible in front of the television 100.

Referring to FIG. 26C, the acoustic discharge ports 37 of the four wideband slot-loading loudspeakers 10 are formed on the front surfaces of the lower end and both side ends of the television 100. Thus, the sound reproduced by the four wideband slot-loading loudspeakers 10 is emitted toward the front of the television 100 through the acoustic discharge ports 37 on the lower and both side ends of the television 100.

As another example, although not illustrated, the acoustic discharge ports 37 of the four wideband slot-loading loudspeakers 10 may be provided on the bottom surface of the lower end and the side surfaces of the both side ends of the television 100. In this case, the sound reproduced by the wideband slot-loading loudspeakers 10 is emitted toward the bottom and both sides of the television 100.

Hereinafter, a case where a wideband slot-loading loudspeaker according to an embodiment of the present disclosure is provided in a mobile device will be described with reference to FIG. 27.

Figure 27:
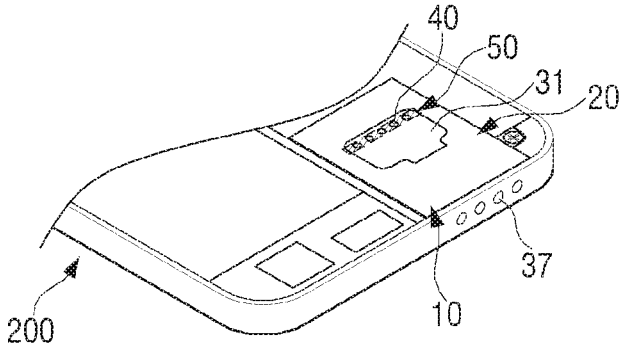
FIG. 27 is a partial perspective view illustrating a smartphone provided with an example wideband slot-loading loudspeaker according to an example embodiment of the present disclosure.

FIG. 27 is a partial perspective view illustrating a smartphone provided with an example wideband slot-loading loudspeaker according to an example embodiment of the present disclosure. FIG. 27 illustrates a state where a cover of the smartphone 200 is removed to show the wideband slot-loading loudspeaker 10.

Referring to FIG. 27, the wideband slot-loading loudspeaker 10 according to an example embodiment of the present disclosure is disposed in the rear surface of the smartphone 200, that is, behind a display which is provided on the front surface of the smartphone 200, and the acoustic discharge port 37 is provided on one side surface of the smartphone 200. A reflective plate 31 is provided with an opening 40 formed in a plurality of holes, and the opening 40 is covered with a sound resistance member 50. Accordingly, the sound reproduced by the wideband slot-loading loudspeaker 10 according to an embodiment of the present disclosure is emitted to the outside through the acoustic discharge port 37 provided on the one side surface of the smartphone 200.

FIG. 27 illustrates the smartphone 200 as an example of the mobile device, but the type of the mobile device is not limited to the smartphone. The wideband slot-loading loudspeaker 10 according to an example embodiment of the present disclosure may be applied to various mobile devices such as a mobile phone, a tablet computer, a notebook computer, and the like.

While various example embodiments of the present disclosure have been described, additional variations and modifications of the example embodiments may occur to those skilled in the art. Therefore, it is intended that the appended claims shall be understood to include both the above embodiments and all such variations and modifications that fall within the spirit and scope of the disclosure.

What is claimed is:

1. An image display apparatus comprising:

a display configured to display an image; and a wideband slot-loading loudspeaker provided behind the display, wherein the wideband slot-loading loudspeaker comprises:

a speaker driver configured to reproduce sound;

an enclosure in which the speaker driver is disposed;

a reflective member spaced apart from a front surface of the speaker driver, wherein a slot is formed in a space between the speaker driver and the reflective member;

an acoustic discharge port provided at one end of the slot, the acoustic discharge port configured to discharge the sound reproduced by the speaker driver;

at least one opening provided in the reflective member; and a sound resistance member disposed at the at least one opening, wherein a speaker diaphragm of the speaker driver is located on a same plane as one side of the acoustic discharge port, and wherein the space between the speaker driver and the reflective member is in fluid communication with outside of the enclosure through the at least one opening.

2. The image display apparatus of claim 1, wherein the reflective member comprises:

a reflective plate disposed to face the front surface of the speaker driver; and a sidewall connecting the reflective plate and a circumference of the speaker driver.

3. The image display apparatus of claim 1, wherein the acoustic discharge port is formed in a plane intersecting a plane extending from the front surface of the speaker driver.

4. The image display apparatus of claim 3, wherein the acoustic discharge port is substantially perpendicular to the plane extending from the front surface of the speaker driver.

5. The image display apparatus of claim 1, wherein the acoustic discharge port is substantially parallel to a plane extending from the front surface of the speaker driver.

6. The image display apparatus of claim 1, wherein the at least one opening is provided in the reflective member and adjacent to the acoustic discharge port.

7. The image display apparatus of claim 1, wherein the at least one opening comprises at least two holes.

8. The image display apparatus of claim 7, wherein the at least two holes are arranged in a straight line.

9. The image display apparatus of claim 8, wherein the at least two holes are arranged substantially parallel to one end of the reflective member at which the acoustic discharge port is provided.

10. The image display apparatus of claim 8, wherein the at least two holes are inclined with respect to one end of the reflective member at which the acoustic discharge port is provided.

11. The image display apparatus of claim 7, wherein the at least two holes have a shape including one or more of a circle, a triangle, a rectangle, an ellipse, and a polygon.

12. The image display apparatus of claim 1, wherein the at least one opening comprises a slit having a length corresponding to a length of one side of the front surface of the speaker driver.

13. The image display apparatus of claim 12, wherein the at least one opening comprises a plurality of slits arranged substantially parallel to each other.

14. The image display apparatus of claim 1, wherein the sound resistance member comprises one of: a mesh and a sponge.

15. The image display apparatus of claim 1, wherein a waveguide is provided at an inlet of the acoustic discharge port.

* * * * *